US007011055B2

(12) United States Patent
Machida et al.

(10) Patent No.: US 7,011,055 B2
(45) Date of Patent: Mar. 14, 2006

(54) VARIABLE VALVE OPERATING CONTROL APPARATUS FOR INTERNAL COMBUSTION ENGINE AND CONTROL METHOD THEREOF

(75) Inventors: Kenichi Machida, Isesaki (JP); Masahiko Watanabe, Atsugi (JP); Yoshiyuki Kobayashi, Atsugi (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 11/065,521

(22) Filed: Feb. 25, 2005

(65) Prior Publication Data

US 2005/0188932 A1 Sep. 1, 2005

(30) Foreign Application Priority Data

Feb. 26, 2004 (JP) ..... 2004-051639
Dec. 28, 2004 (JP) ..... 2004-380637

(51) Int. Cl.
*F01L 1/34* (2006.01)

(52) U.S. Cl. ..... 123/90.15; 123/90.16; 123/90.17; 123/90.2; 123/90.31

(58) Field of Classification Search ..... 123/90.15, 123/90.16
See application file for complete search history.

(56) References Cited

U.S. PATENT DOCUMENTS 5,937,805 A * 8/1999 Matsumura ..... 123/90.15
6,920,852 B1 * 7/2005 Machida ..... 123/90.16
2003/0145815 A1 8/2003 Miyakoshi
2004/0015287 A1 1/2004 Ilzuka et al.

FOREIGN PATENT DOCUMENTS

EP 1 306 528 A2 5/2003
EP 1 310 635 A2 5/2003
JP 2000-087769 A 3/2000

OTHER PUBLICATIONS

U.S. Appl. No. 11/064,100, filed Feb. 23, 2005, Machida et al.*

* cited by examiner

*Primary Examiner*—Thomas Denion
*Assistant Examiner*—Kyle M. Riddle
(74) *Attorney, Agent, or Firm*—Foley & Lardner LLP

(57) ABSTRACT

A centric phase of an operating angle of an engine valve is detected on the basis of an interval between a reference rotational position of a crankshaft and a reference rotational position of a camshaft, and on the other hand, the centric phase is detected at a period shorter than a period between the reference rotational positions, and one of those detected results is selected on the basis of a predetermined regulation, and an opening characteristic of the engine valve is operated on the basis of the selected centric phase.

20 Claims, 28 Drawing Sheets

VARIABLE VALVE OPERATING CONTROL APPARATUS FOR INTERNAL COMBUSTION ENGINE AND CONTROL METHOD THEREOF

BACKGROUND OF THE INVENTION

1. Field of the Invention

The present invention relates to a variable valve operating control apparatus of an internal combustion engine having a variable valve timing mechanism and a control method thereof.

2. Description of the Related Art

In Japanese Unexamined Patent Publication 2000-087769, there is disclosed an variable valve operating control apparatus which has a variable valve timing mechanism which varies a rotational phase of a camshaft with respect to a crankshaft of an internal combustion engine, and a variable valve lift mechanism which varies a lift of an engine valve.

In a conventional art, a rotational phase adjusted by a variable valve timing mechanism is detected on the basis of a interval between a detection signal at a reference rotational position of a crankshaft and a detection signal at a reference rotational position of a camshaft.

Then, the aforementioned variable valve timing mechanism is feedback-controlled on the basis of a detected rotational phase on the basis of the interval.

Therefore, there has been the problem that the feedback control of a rotational phase cannot be carried out when a sensor detecting the reference rotational positions breaks down.

Further, in the structure in which a rotational phase is detected on the basis of the detection signals of the reference rotational positions, a rotational phase is detected at every constant crank angle.

Therefore, if an updating period of a rotational phase is made long because of the time when an engine speed is low, a large deviation is generated between a detected value of the rotational phase and an actual value during the updating period.

For example, when a centric phase of an operating angle of an intake valve is made to vary by the variable valve timing mechanism while varying a lift of the intake valve, a variation of increase and decrease in an air quantity with respect to a variation of the centric phase becomes large at the time of low lift.

Therefore, when a rotational phase at a side which is further advance side than an actual angle is detected due to a delay in updating the rotational phase when the rotational phase is being varied in the retard direction, the rotational phase is controlled to be excessively at the retard side. Then, if the rotational phase is excessively set at the retard, a cylinder intake air quantity is increased beyond a request.

Moreover, when an operating angle/a lift of an engine valve are made variable, the maximum operating angle/the maximum lift which can prevent the interference between a piston and the engine valve are different in accordance with a centric phase of the operating angle.

Therefore, when there is a delay in detecting a centric phase, the maximum operating angle/the maximum lift are wrongly set, and as a result, there is a concern in which the mechanism may be controlled so as to be an operating angle/a lift by which the piston and the engine valve interfere with one another.

SUMMARY OF THE INVENTION

Then, an object of the present invention is to be able to control the opening characteristic of an engine valve so as to be at the safe side even if there is a sensor failure or a delay in updating a rotational phase detected on the basis of reference rotational positions.

In order to achieve the above-described object, in the present invention, a centric phase of the operating angle of the engine valve is detected on the basis of an interval between a reference rotational position of the crankshaft and a reference rotational position of the camshaft, and on the other hand, the centric phase of the operating angle of the engine valve is detected at a period shorter than a period between the reference rotational positions, and one of a most up-to-date value of the centric phase detected at every reference rotational position and a most up-to-date value of the centric phase detected at a period shorter than the period between the reference rotational positions is selected on the basis of a predetermined regulation, and the opening characteristic of the engine valve is operated on the basis of the selected centric phase.

The other objects and features of this invention will become understood from the following description with reference to the accompanying drawing.

PREFERRED EMBODIMENT

Figure 1:
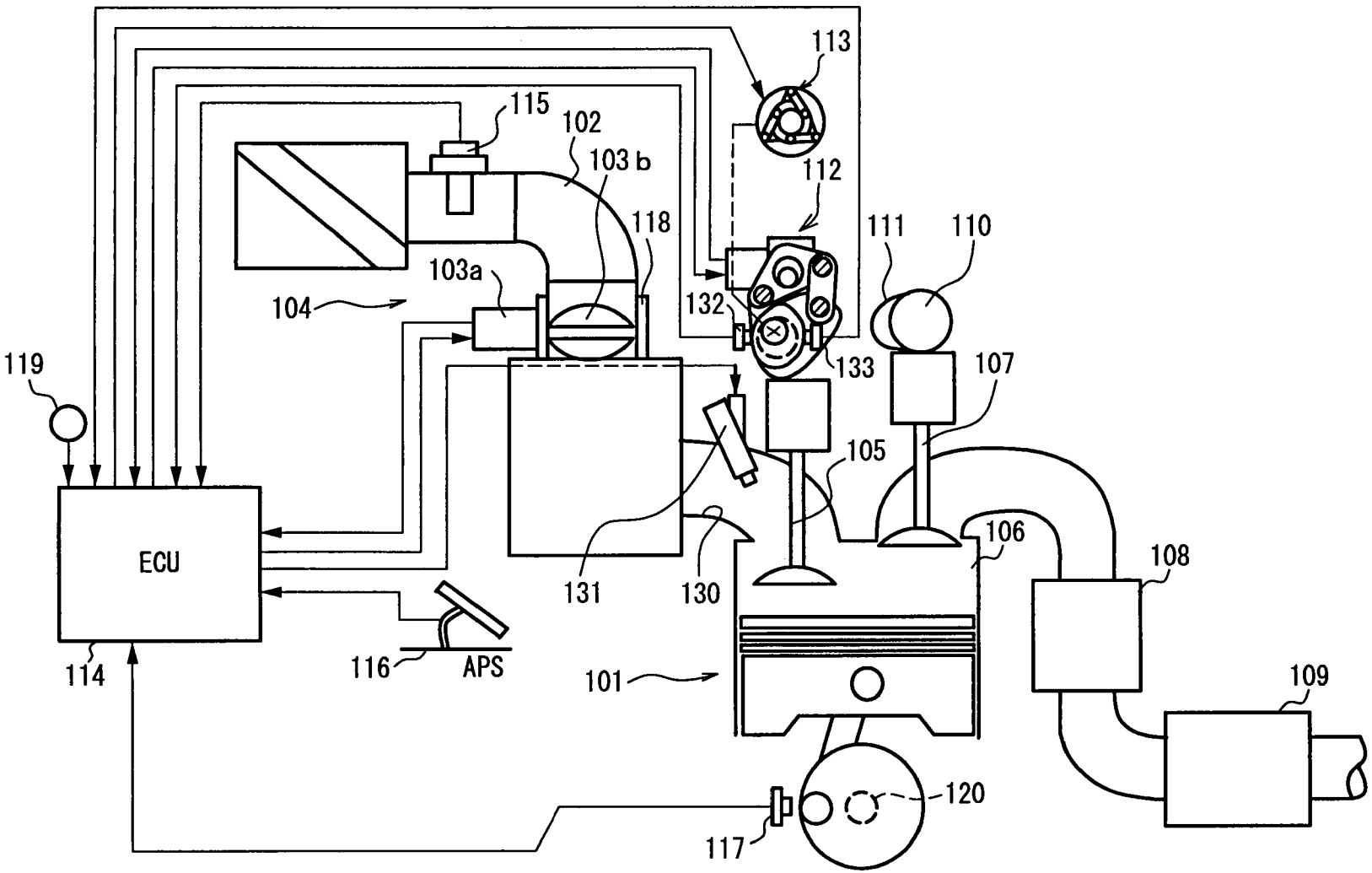
FIG. 1 is a system diagram of an internal combustion engine in an embodiment of the present invention.

FIG. 1 is a system block diagram of an engine on vehicle in an embodiment.

An electronic control throttle 104 is set at an intake pipe 102 of an internal combustion engine 101 in FIG. 1.

Electronic control throttle 104 is a device controlling to open and close a throttle valve 103*b* by a throttle motor 103*a*.

Then, air is sucked into a combustion chamber 106 of engine 101 via electronic control throttle 104 and an intake valve 105.

Exhaust gas of engine 101 is exhausted from combustion chamber 106 via an exhaust valve 107, and thereafter, the exhaust gas is purged through a front catalytic converter 108 and a rear catalytic converter 109, and is discharged in the atmosphere.

Exhaust valve 107 is controlled to open and close so as to maintain given lift, operating angle, and valve timing by a cam 111 supported pivotally by an exhaust side camshaft 110.

On the other hand, a Variable valve Event and Lift (VEL) mechanism 112 which sequentially varies a lift of intake valve 105 along with an operating angle is provided at intake valve 105 side.

Moreover, a Variable valve Timing Control (VTC) mechanism 113 which sequentially varies a centric phase of the operating angle of intake valve 105 by varying a rotational phase of a camshaft which is at the air-intake side with respect to a crankshaft 120 is provided at intake valve 105 side.

An engine control unit (ECU) 114 in which a microcomputer is built-in controls VEL mechanism 112 and VTC mechanism 113 so as to obtain a required intake air quantity, a required cylinder residual gas ratio, and the like which correspond to a required torque, and on the other hand, controls electronic control throttle 104 so as to obtain a required suction pressure.

Detection signals from an air flow meter 115 detecting an intake air quantity of internal combustion engine 101, an accelerator pedal sensor 116 detecting an opening of an accelerator, a crank angle sensor 117 taking a unit angle signal POS at every unit crank angle out of crankshaft 120, a throttle sensor 118 detecting an opening TVO of a throttle valve 103*b*, a water temperature sensor 119 detecting a temperature of cooling water in internal combustion engine 101, and a cam sensor 132 taking a cam signal CAM out of the camshaft are inputted to ECU 114.

Figure 11:
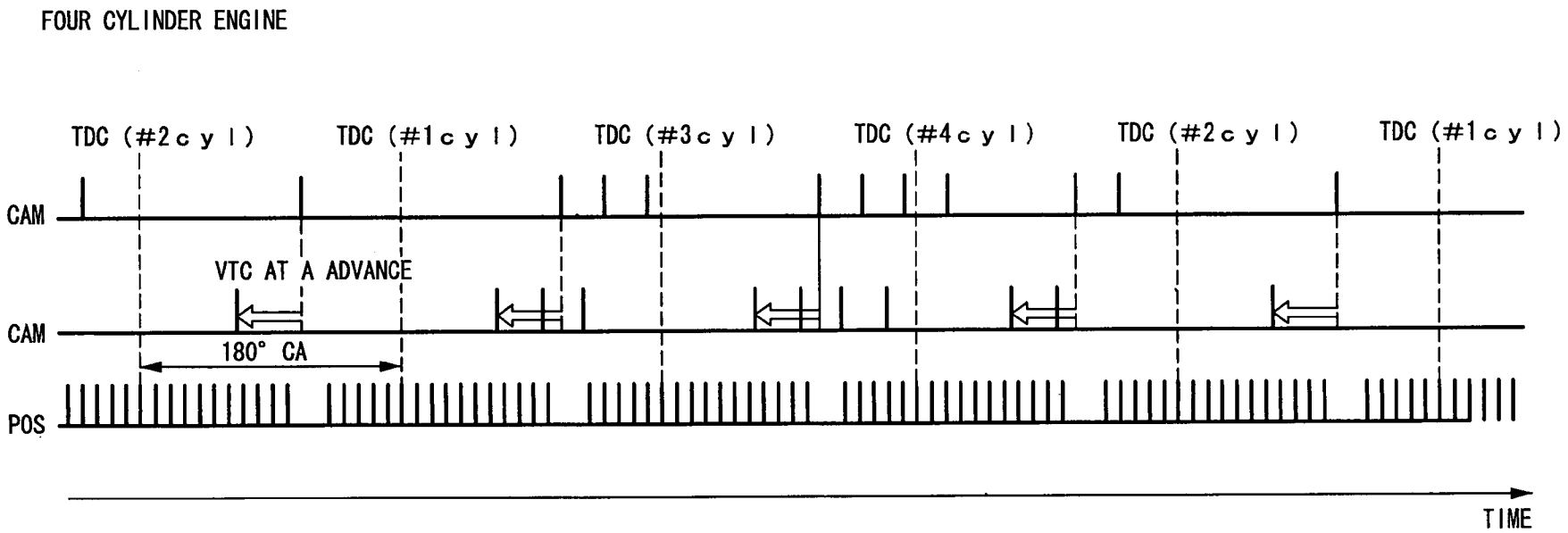
FIG. 11 is a timing chart showing output signals of a crank angle sensor and a cam sensor in the embodiment.

Here, crank angle sensor 117 detects a portion to be detected which is provided at every crank angle of 10° with respect to a rotator rotating so as to be integrated with crankshaft 120, and in accordance therewith, as shown in FIG. 11, crank angle sensor 117 outputs a unit angle signal POS at every crank angle of 10°. However, crank angle sensor 117 is structured that, because two points of the portions to be detected are sequentially omitted at two points with an interval at a crank angle of 180°, unit angle signals POS is not outputted sequentially twice.

Note that the crank angle of 180° corresponds to a phase difference of the strokes between the cylinders in a four-cylinder engine in the present embodiment.

Then, the portion at which unit angle signal POS is interrupted for a short time is detected on the basis of an output period and the like of unit angle signal POS, and for example, a reference rotational position of crankshaft 120 is detected on the basis of a unit angle signal POS which is outputted for the first time after unit angle signal POS is interrupted.

ECU 114 calculates an engine rotational speed by counting a period between detecting the reference rotational positions or a number of generating unit angle signals POS per a predetermined time.

Note that it may be a structure in which such that crank angle sensor 117 separately outputs a reference angle signal REF at every reference rotational position (at every angle of 180°) of crankshaft 120 and a unit angle signal POS without any omission.

Further, cam sensor 132 outputs a cam signal CAM denoting a cylinder number (the first cylinder through the fourth cylinder) by a pulse number at every cam angle of 90° corresponding to a crank angle of 180° as shown in FIG. 11, by detecting a portion to be detected which is provided at the rotator rotating so as to be integrated with the camshaft.

An electromagnetic fuel injection valve 131 is provided at an intake port 130 at an upstream side of intake valve 105 in each cylinder.

Fuel injection valve 131 is controlled to open the valve by an injection pulse signal from ECU 114, and injects fuel of a quantity which is in proportion to an injection pulse width of the injection pulse signal.

Figure 2:
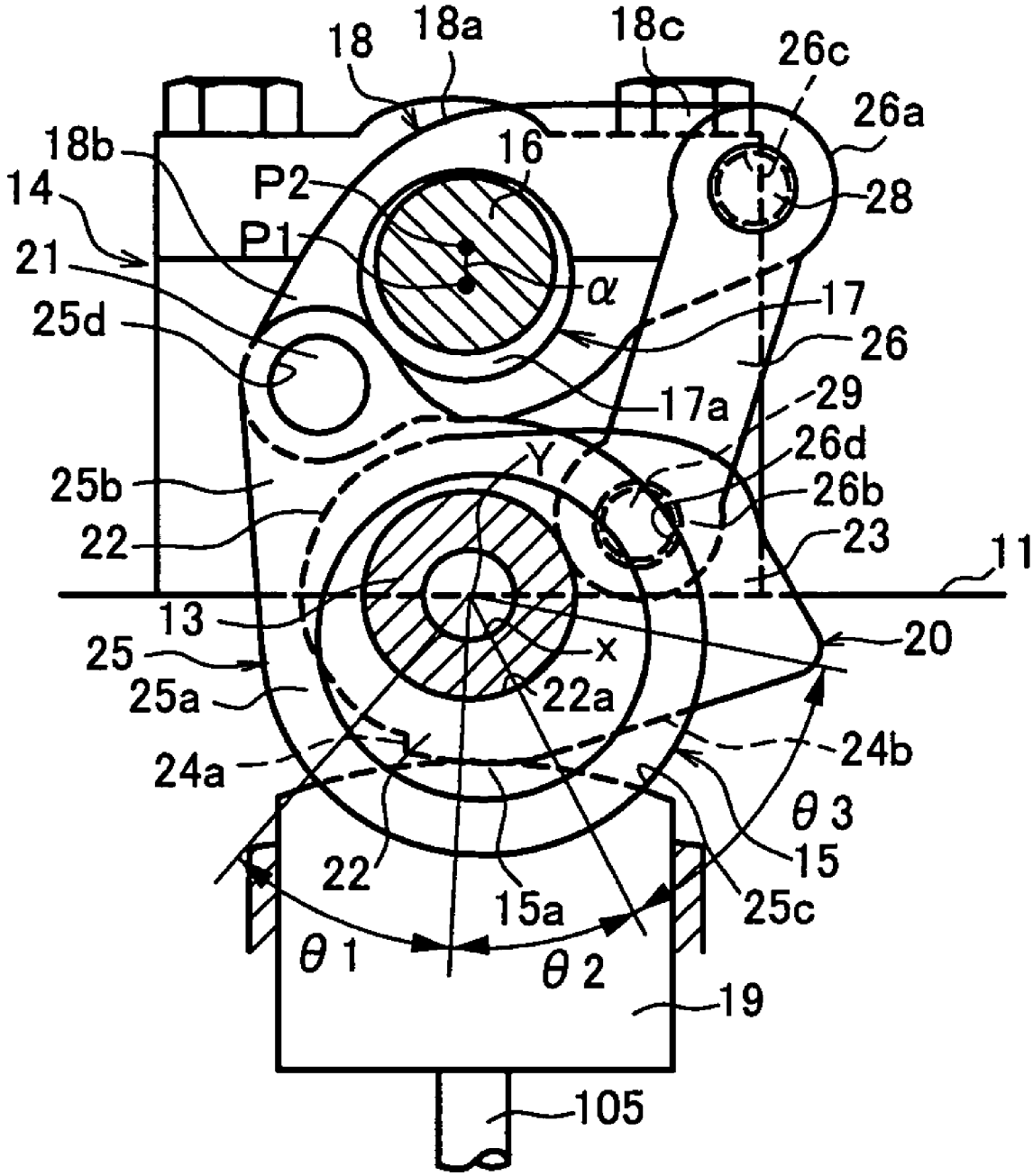
FIG. 2 is a sectional view (taken along A—A in FIG. 3) showing a Variable valve Event and Lift mechanism in the embodiment.
Figure 3:
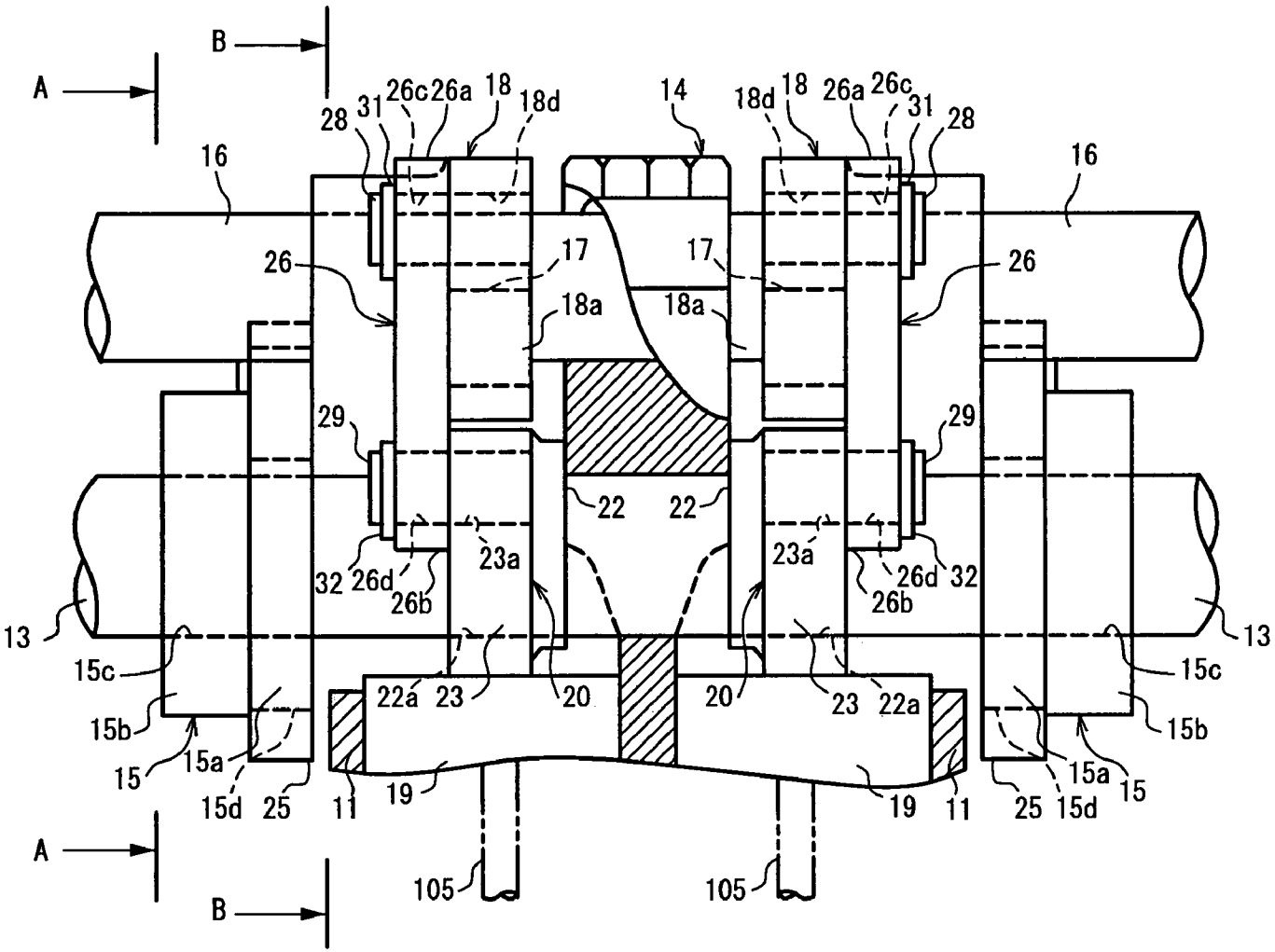
FIG. 3 is a side elevation of the Variable valve Event and Lift mechanism.
Figure 4:
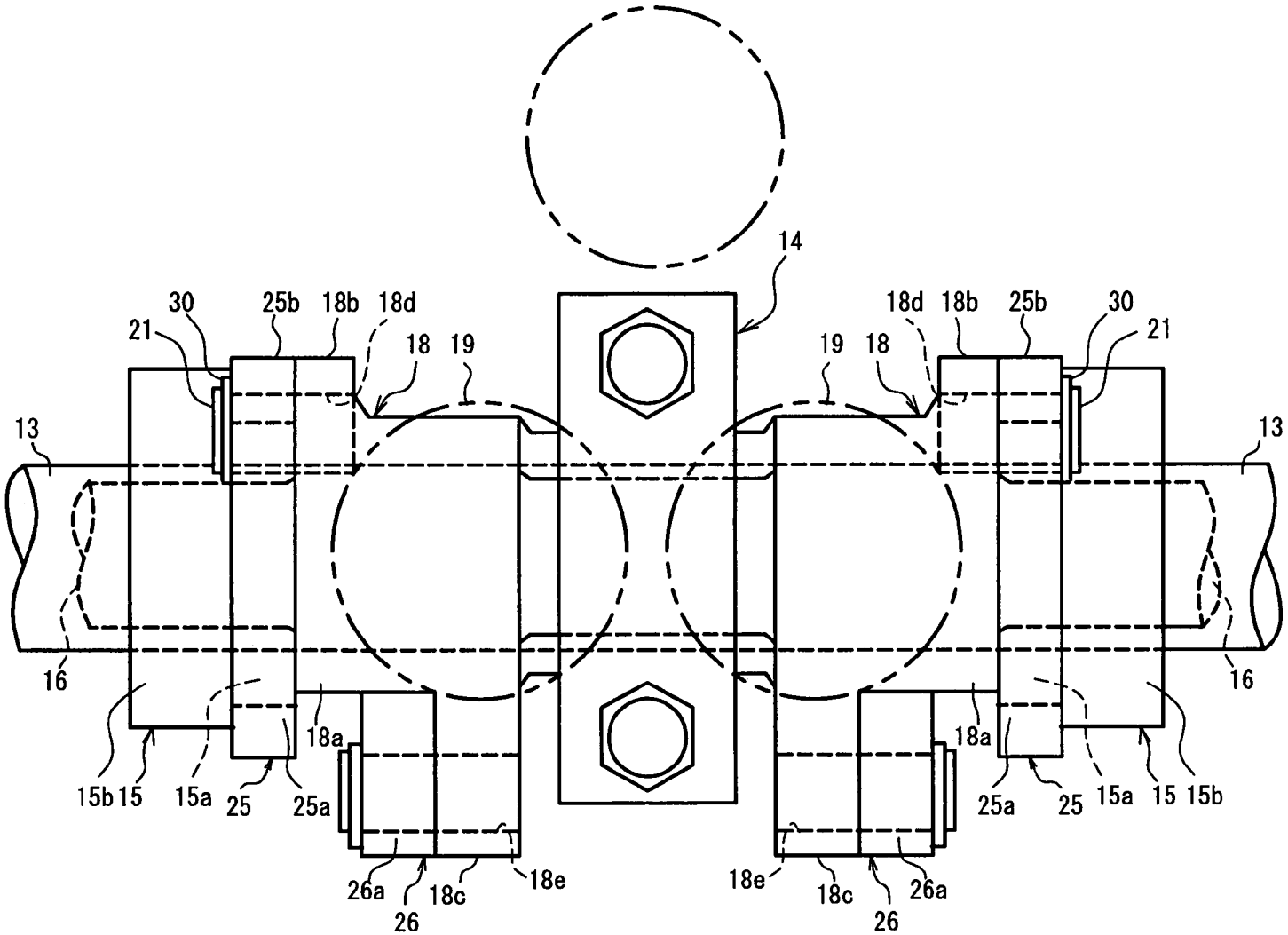
FIG. 4 is a plan view of the Variable valve Event and Lift mechanism.

FIG. 2 to FIG. 4 show the structure of VEL mechanism 112 in detail.

VEL mechanism 112 shown in FIG. 2 to FIG. 4 has a pair of intake valves 105 and 105, a hollow shaped camshaft 13 (driving shaft) supported to be freely pivotable by a cam bearing 14 of a cylinder head 11, two eccentric cams 15 and 15 (driving cams) which are the rotating cams supported pivotally by camshaft 13, a control shaft 16 supported to be freely pivotable by the same cam bearing 14 at a position above camshaft 13, a pair of rocker arms 18 and 18 supported to be freely rockable via a control cam 17 by control shaft 16, and a pair of respectively separated rocker cams 20 and 20 which are disposed via valve lifters 19 and 19 at the top end portions of respective intake valves 105 and 105.

Eccentric cams 15 and 15, and rocker arms 18 and 18 are linked with one another by link arms 25 and 25, and rocker arms 18 and 18, and rocker cams 20 and 20 are linked with one another by link members 26 and 26.

Rocker arms 18 and 18, link arms 25 and 25, and link members 26 and 26 structure a transmission mechanism.

Figure 5:
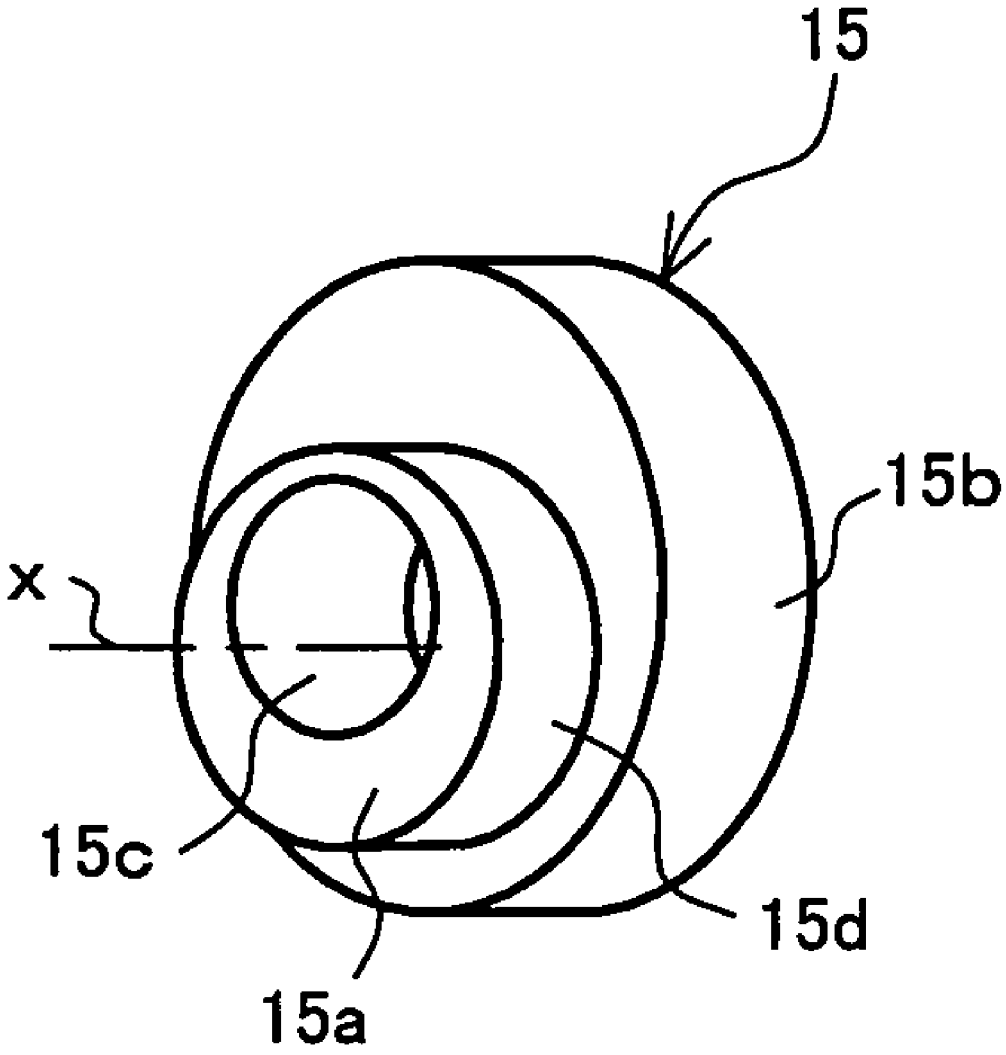
FIG. 5 is a perspective view showing an eccentric cam used for the Variable valve Event and Lift mechanism.

As shown in FIG. 5, eccentric cam 15 is formed in a substantially ring shape, and is formed from a small-diameter cam main body 15*a* and a flange portion 15*b* provided so as to be integrated with the outer end surface of cam main body 15*a*, and a camshaft through hole 15*c* is formed so as to pass through in the inner axis direction, and the axis X of cam main body 15*a* is eccentric by a predetermined amount from the axis Y of camshaft 13.

Further, eccentric cams 15 are fixed to be press-fitted at the both outer sides which do not interfere with valve lifters 19 with respect to camshaft 13 via camshaft through hole 15*c*.

Rocker arm 18 is, as shown in FIG. 4, formed to be wound in a substantially crank shape, and a base portion 18*a* at the center thereof is supported to be freely pivotable by control cam 17.

A pin hole 18*d* into which a pin 21 connected to a top end portion of link arm 25 is press-fitted is formed so as to pass through one end portion 18*b* provided so as to protrude at the outer end portion of base portion 18*a*, and on the other hand, a pin hole 18*e* into which a pin 28 linking together with one end portion 26*a*, which will be described later, of each link member 26 is press-fitted is formed at an other end portion 18*c* provided so as to protrude at the inner end portion of base portion 18*a*.

Control cam 17 is formed in a cylinder shape, and is fixed to the outer periphery of control shaft 16, and as shown in FIG. 2, the position of an axis position P1 is eccentric by $\alpha$ from an axis P2 of control shaft 16.

Figure 6:
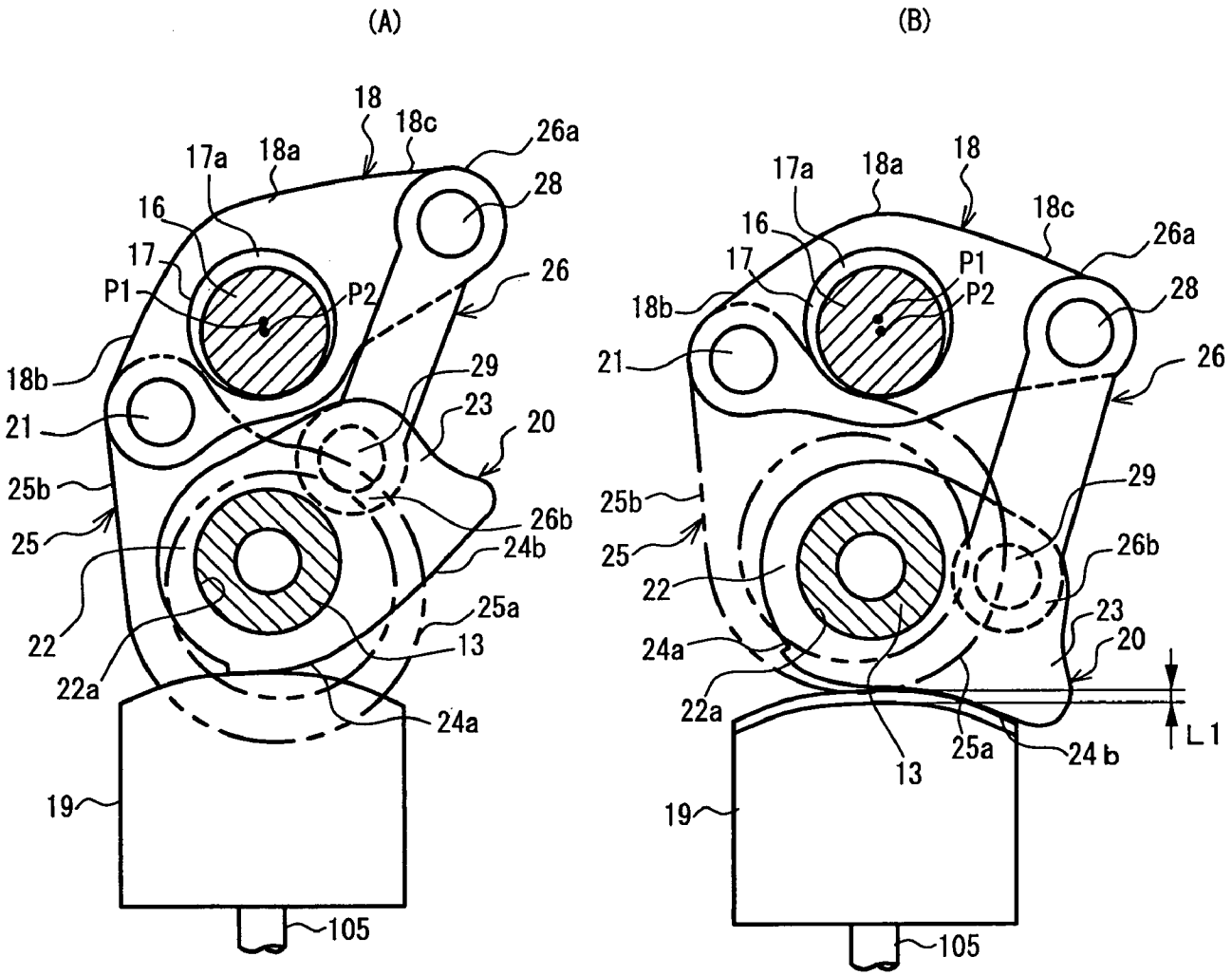
FIG. 6 is a sectional view (taken along B—B in FIG. 3) showing a low-lift state of the Variable valve Event and Lift mechanism.
Figure 7:
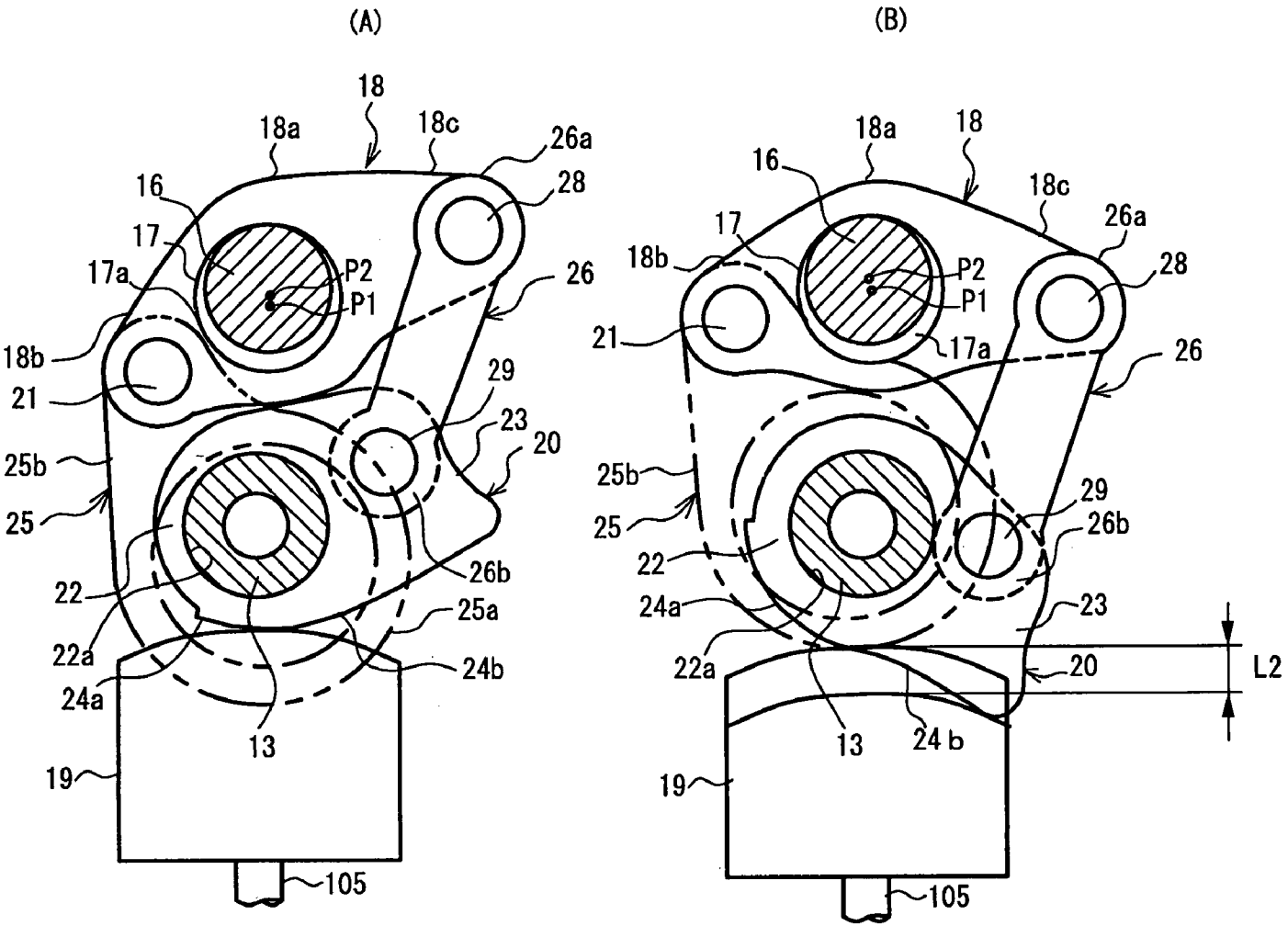
FIG. 7 is a sectional view (taken along B—B in FIG. 3) showing a high-lift state of the Variable valve Event and Lift mechanism.

Rocker cam 20 is, as shown in FIG. 2, FIG. 6, and FIG. 7, substantially a horizontal U-shape, and a bearing hole 22*a* into which camshaft 13 is supported to be freely pivotable by being fitted is formed so as to pass through a substantially ring shaped base end portion 22, and a pin hole 23*a* is formed so as to pass through an end portion 23 positioned at the other end portion 18*c* of rocker arm 18.

Further, a basic circular surface 24*a* at base end portion 22 side and a cam surface 24*b* extending so as to be a circular arc shape from basic circular surface 24*a* to an end portion 23 edge side are formed on the lower surface of rocker arm 20, and basic circular surface 24*a* and cam surface 24*b* are structured so as to touch a predetermined position on the top surface of each valve lifter 19 in accordance with a rocked position of rocker cam 20.

Figure 8:
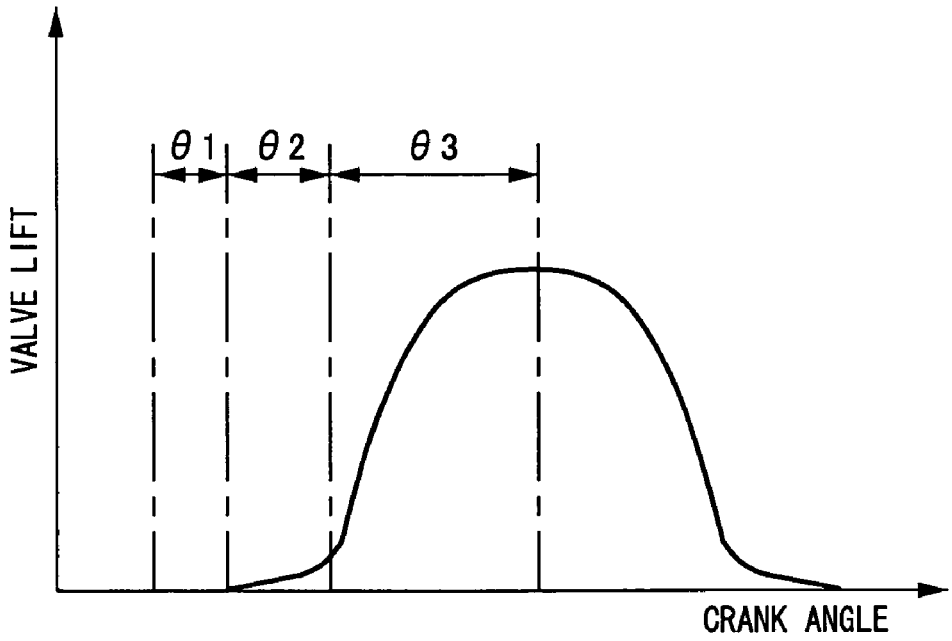
FIG. 8 is a characteristic diagram of a lift in the Variable valve Event and Lift mechanism.

Namely, from the standpoint of the lift characteristic shown in FIG. 8, a predetermined angle range $\theta 1$ on basic circular surface 24*a* is set so as to be a base circle zone as shown in FIG. 2, and a zone from base circle zone $\theta 1$ to a predetermined angle range $\theta 2$ on cam surface 24*b* is set so as to be a so-called ramp zone, and moreover, a zone from ramp zone $\theta 2$ to a predetermined angle range $\theta 3$ on cam surface 24*b* is set so as to be is a lift zone.

Further, link arm 25 has a ring shaped base portion 25*a* and a protruded end 25*b* provided so as to protrude at a predetermined position on the outer peripheral surface of base portion 25*a*, and an fitting-into hole 25*c* which is fitted with the outer peripheral surface of cam main body 15*a* of eccentric cam 15 to be freely pivotable is formed at the central position of base portion 25*a*, and a pin hole 25*d* into which pin 21 is inserted to be freely pivotable is formed so as to pass through protruded end 25*b*.

Moreover, link member 26 is formed in a straight shape with a predetermined length, and pin through holes 26*c* and 26*d* into which the end portions of respective pins 28 and 29 which have been press-fitted into respective pin holes 18*d* and 23*a* of the other end portion 18*c* of rocker arm 18 and the end portion 23 of rocker cam 20 are inserted to be freely rotatable are formed so as to pass through the circular both end portions 26*a* and 26*b*.

Note that snap rings 30, 31, and 32 regulating the movements in the axis direction of link arm 25 and link member 26 are provided to one end portions of respective pins 21, 28, and 29.

In the above-described structure, as shown in FIGS. 6 and 7, the lift is varied in accordance with a positional relationship between axis P2 of control shaft 16 and axis P1 of control cam 17, and the position of axis P2 of control shaft 16 with respect to axis P1 of control cam 17 is varied by controlling control shaft 16 to rotate.

Figure 9:
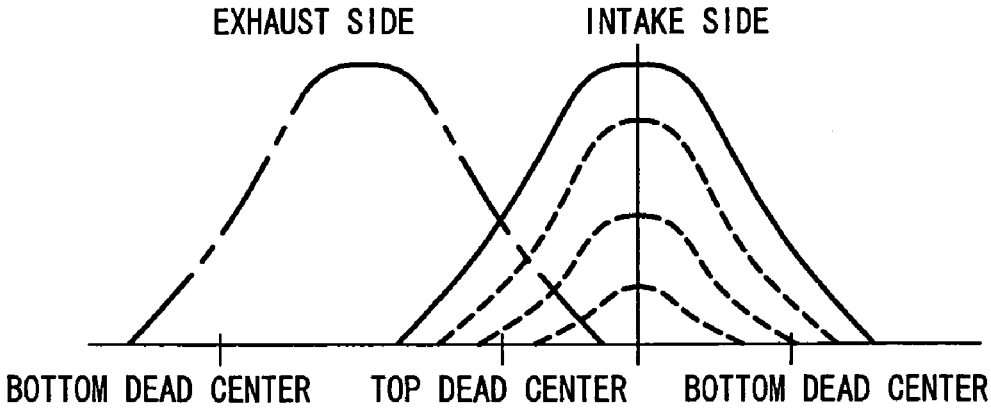
FIG. 9 is a characteristic diagram showing a correlation between an operating angle and a lift in the Variable valve Event and Lift mechanism.
Figure 10:
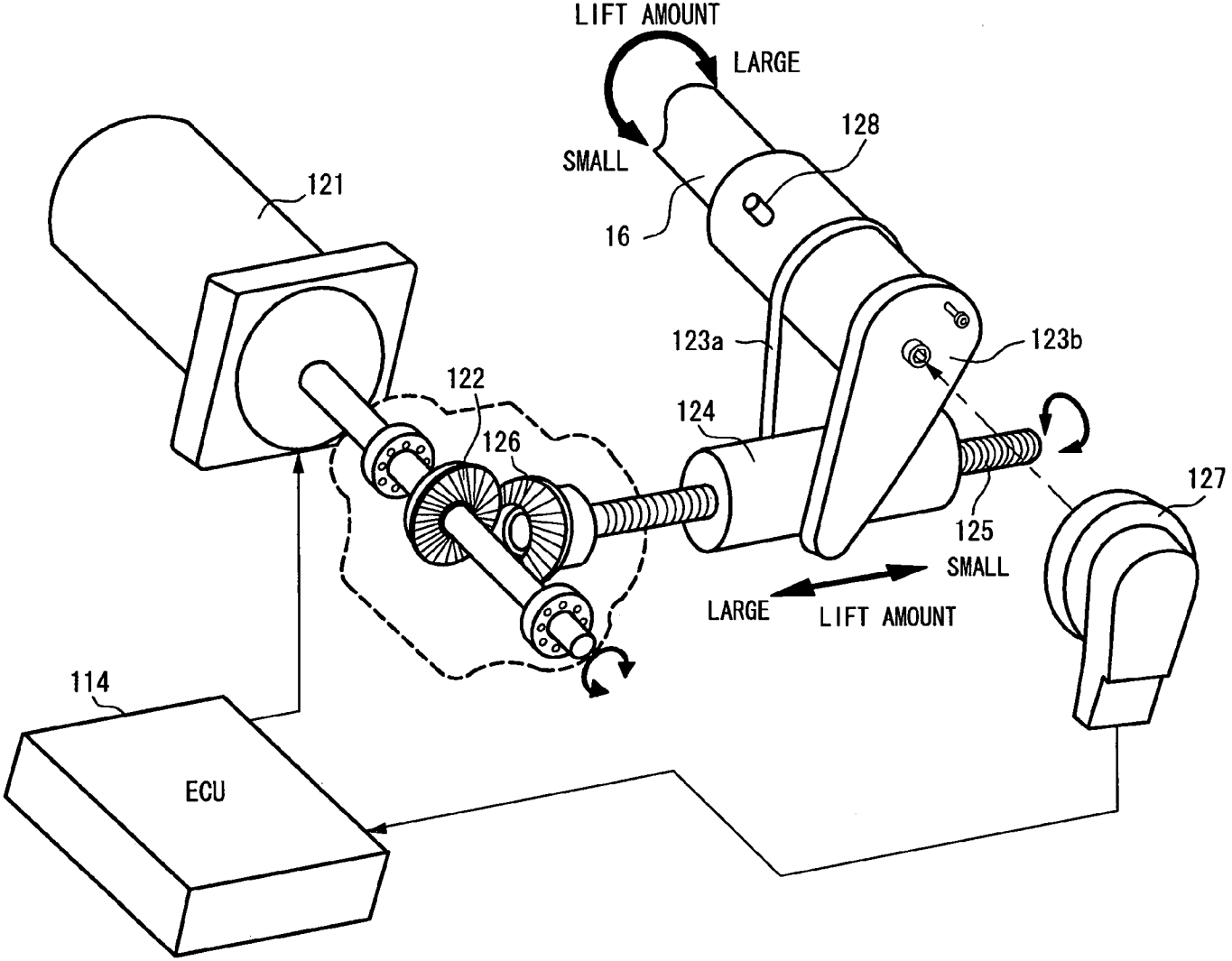
FIG. 10 is a perspective view showing a driving mechanism of a control shaft in the Variable valve Event and Lift mechanism.

Control shaft 16 is, in accordance with a structure as shown in FIG. 10, controlled to rotate by a DC servo motor (actuator) 121 within a predetermined rotational angle range limited by a stopper, and due to the angle of control shaft 16 being varied by actuator 121, the lift and the operating angle of intake valve 105 are sequentially varied within a range, which is limited by the stopper, between the maximum lift and the minimum lift (refer to FIG. 9).

In FIG. 10, DC servo motor 121 is disposed such that the rotating shaft thereof is made to be parallel with control shaft 16, and a bevel gear 122 is supported pivotally at the top end of the rotating shaft.

On the other hand, a pair of stays 123*a* and 123*b* are fixed to the top end of control shaft 16, and a nut 124 is supported so as to be rockable about the shaft which is parallel with control shaft 16 to which the top end portions of the pair of stays 123*a* and 123*b* are connected.

A bevel gear 126 engaged into bevel gear 122 is supported pivotally at the top end of a threaded bar 125 made to engage with nut 124, and threaded bar 125 is made to rotate by a rotation of DC servo motor 121, and a position of nut 124 engaging with threaded bar 125 is displaced in the axis direction of threaded bar 125, and therefore, control shaft 16 is made to rotate.

Here, the direction in which the position of nut 124 is made to approach to bevel gear 126 is a direction in which a valve lift is made small, and in contrast thereto, the direction in which the position of nut 124 is made be away from bevel gear 126 is a direction in which a valve lift is made large.

As shown in FIG. 10, a potentiometer system angle sensor 127 detecting an angle of control shaft 16 is provided at the top end of control shaft 16, and ECU 114 feedback-controls DC servo motor 121 such that an actual angle detected by angle sensor 127 is made to agree with a target angle (a value corresponding to a target lift).

Next, the structure of VTC mechanism 113 will be described with reference to FIG. 12 to FIG. 22.

Figure 12:
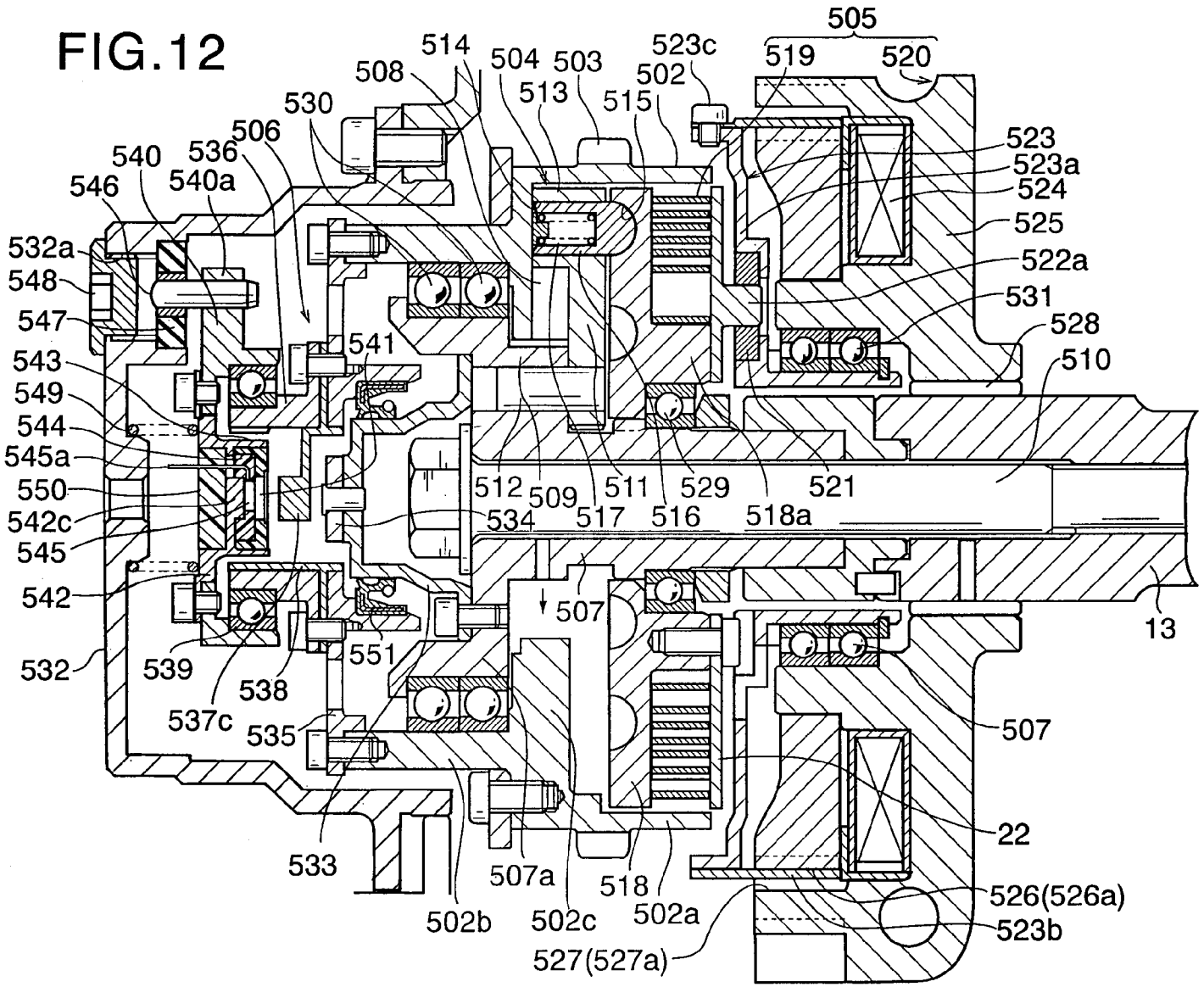
FIG. 12 is a sectional view showing a Variable valve Timing Control mechanism in the embodiment.

As shown in FIG. 12, VTC mechanism 113 has a timing sprocket 502 which is assembled into the front end portion of camshaft 13 so as to be relatively rotatable, and which is made to link with crankshaft 120 via a timing chain (not shown), assembling angle changing means 504 changing an assembling angle between timing sprocket 502 and camshaft 13, operating force providing means 505 driving the assembling angle changing means 504, relative displacement detecting means 506 detecting an angle of relative rotational displacement of camshaft 13 with respect to timing sprocket 502, and a VTC cover 532 covering the front surfaces of assembling angle changing means 504 and relative displacement detecting means 506, and which is mounted on a cylinder head cover of the cylinder head.

A driven shaft member 507 is fixed to the end portion of camshaft 13 by a cam bolt 510.

A flange 507*a* is provided so as to be integrated with driven shaft member 507.

Timing sprocket 502 is formed from a large-diameter cylinder portion 502*a* at which a gear portion 503 with which the timing chain is engaged is formed, a small-diameter cylinder portion 502*b*, and a disk portion 502*c* connecting between cylinder portion 502*a* and cylinder portion 502*b*.

Cylinder portion 502*b* is assembled so as to be rotatable by a ball bearing 530 with respect to flange 507*a* of driven shaft member 507.

Figure 13:
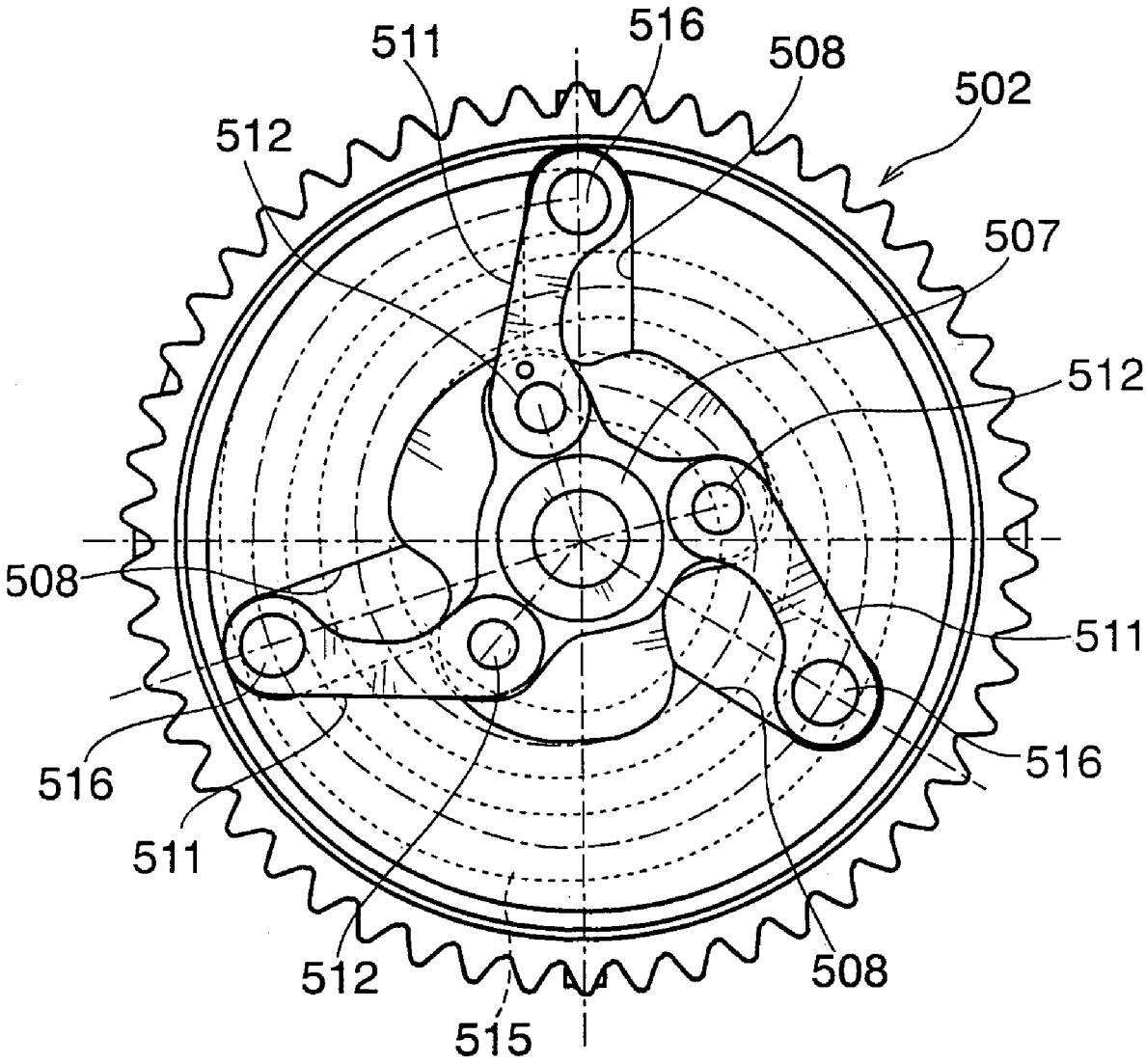
FIG. 13 is a diagram showing the Variable valve Timing Control mechanism in a state of the maximum retard.
Figure 14:
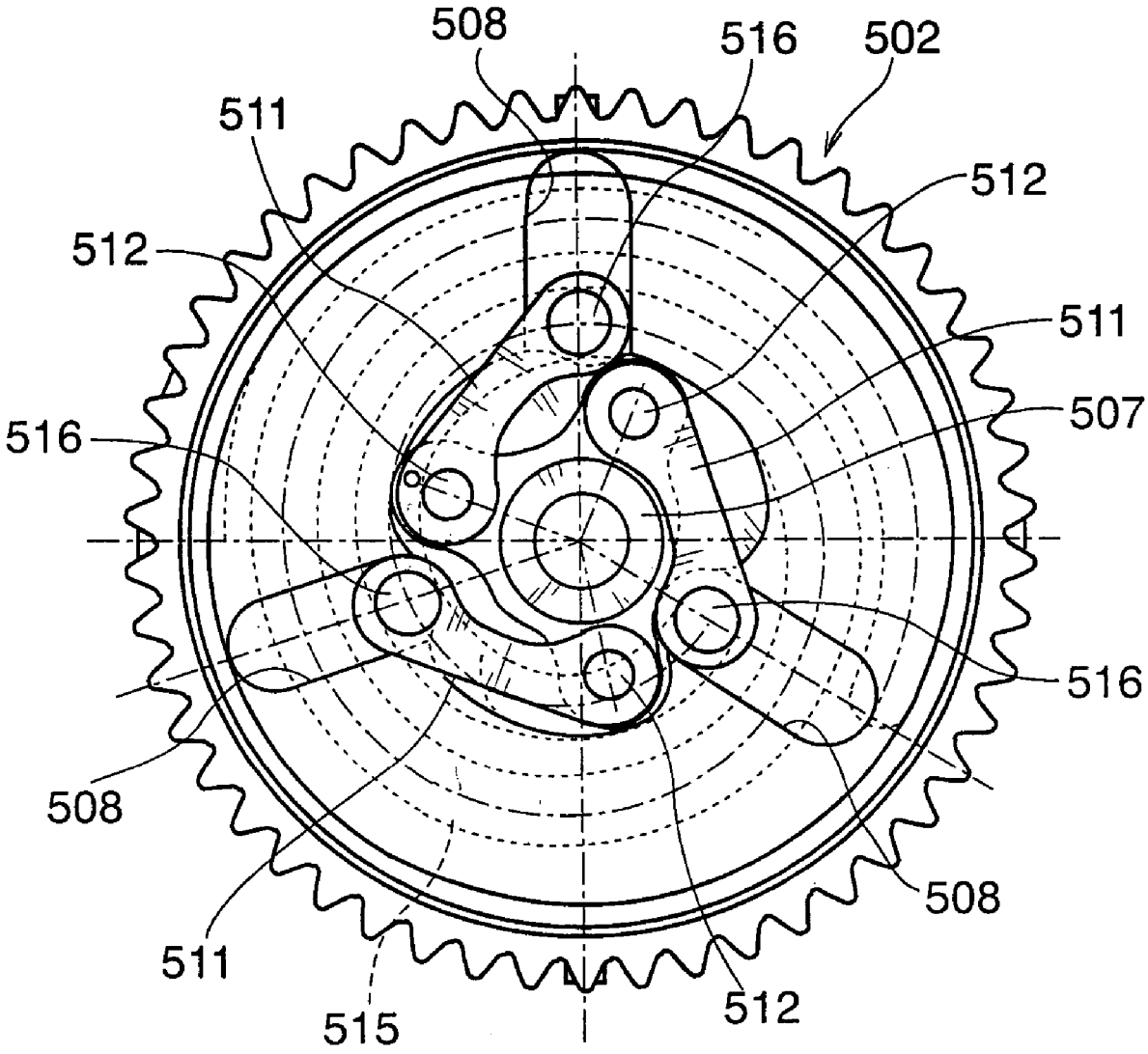
FIG. 14 is a diagram showing the Variable valve Timing Control mechanism in a state of the maximum advance.
Figure 15:
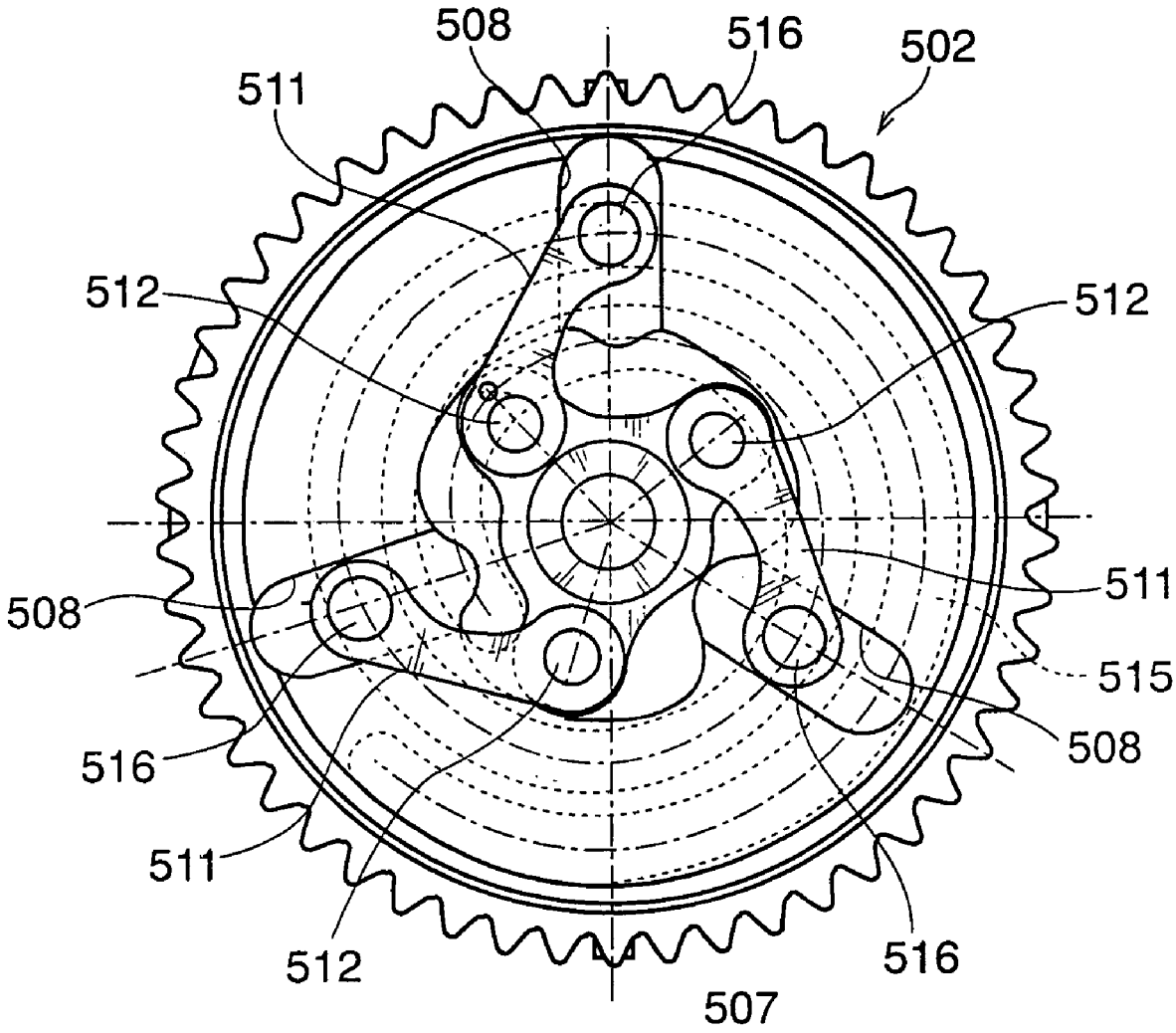
FIG. 15 is a diagram showing the Variable valve Timing Control mechanism in a state of the intermediate advance.

As shown in FIG. 13 to FIG. 15, three grooves 508 are formed in a radial pattern along radial directions of timing sprocket 502 at the surface at cylinder portion 502*b* side of disk portion 502*c*.

Further, three protruding portions 509 protruding in a radial pattern in radial directions are formed so as to be integrated with the camshaft 1 side end surface of flange portion 507*a* of driven shaft member 507.

The base ends of three links 511 are respectively connected to respective protruding portions 509 so as to be rotatable by pins 512.

Cylindrical lobes 513 engaging with respective grooves 508 so as to be freely rockable are formed so as to be integrated with the top ends of respective links 511.

Because respective links 511 are connected to driven shaft member 507 via pins 512 in a state in which respective lobes 513 engage with corresponding grooves 508, when the top end sides of links 511 are displaced along grooves 508 by receiving external force, timing sprocket 502 and driven shaft member 507 are relatively rotated by the effects of respective links 511.

Further, accommodating holes 514 opening toward camshaft 13 side are formed at lobes 513 of respective links 511.

An engagement pin 516 engaging with a spiral slot 515 which will be described later, and a coil spring 517 urging engagement pin 516 against spiral slot 515 side are accommodated in accommodating hole 514.

On the other hand, a disk type intermediate rotator 518 is supported to be freely pivotable via a bearing 529 at driven shaft member 507 which is further at the camshaft 1 side than protruding portion 509.

Spiral slot 515 is formed at the end surface at the protruding portion 509 side of intermediate rotator 518, and engagement pins 516 at the top ends of respective links 511 are engaged with spiral slot 515.

Spiral slot 515 is formed so as to gradually reduce the diameter along the rotational direction of timing sprocket 502.

Accordingly, when intermediate rotator 518 is relatively displaced in the retard direction with respect to timing sprocket 502 in a state in which respective engagement pins 516 engage with spiral slot 515, the top end portions of respective links 511 are moved toward the inside in the radial direction by being led by spiral slot 515 while being guided by grooves 508.

In contrast thereto, when intermediate rotator 518 is relatively displaced in the advance direction with respect to timing sprocket 502, the top end portions of respective links 511 are moved toward the outside in the radial direction.

Assembling angle changing means 504 is structured from grooves 508, links 511, lobes 513, engagement pins 516, intermediate rotator 518, spiral slot 515, and the like of timing sprocket 502.

When an operating force for rotations is inputted from the operating force providing means 505 to intermediate rotator 518, the top ends of links 511 are displaced in radial directions, and the displacement is transmitted as a turning force which varies an angle of the relative displacement between timing sprocket 502 and driven shaft member 507 via links 511.

Operating force providing means 505 has a spiral spring 519 urging intermediate rotator 518 in the rotational direction of timing sprocket 502, and a hysteresis brake 520 generating braking force which rotates intermediate rotator 518 in a direction opposite to the rotational direction of timing sprocket 502.

Here, ECU 114 controls braking force of the hysteresis brake 520 in accordance with a operating state of internal combustion engine 101, and in accordance therewith, intermediate rotator 518 can be relatively rotated with respect to timing sprocket 502 up to a position where the urging force of spiral spring 519 and the braking force of hysteresis brake 520 are made to be in balance.

Figure 16:
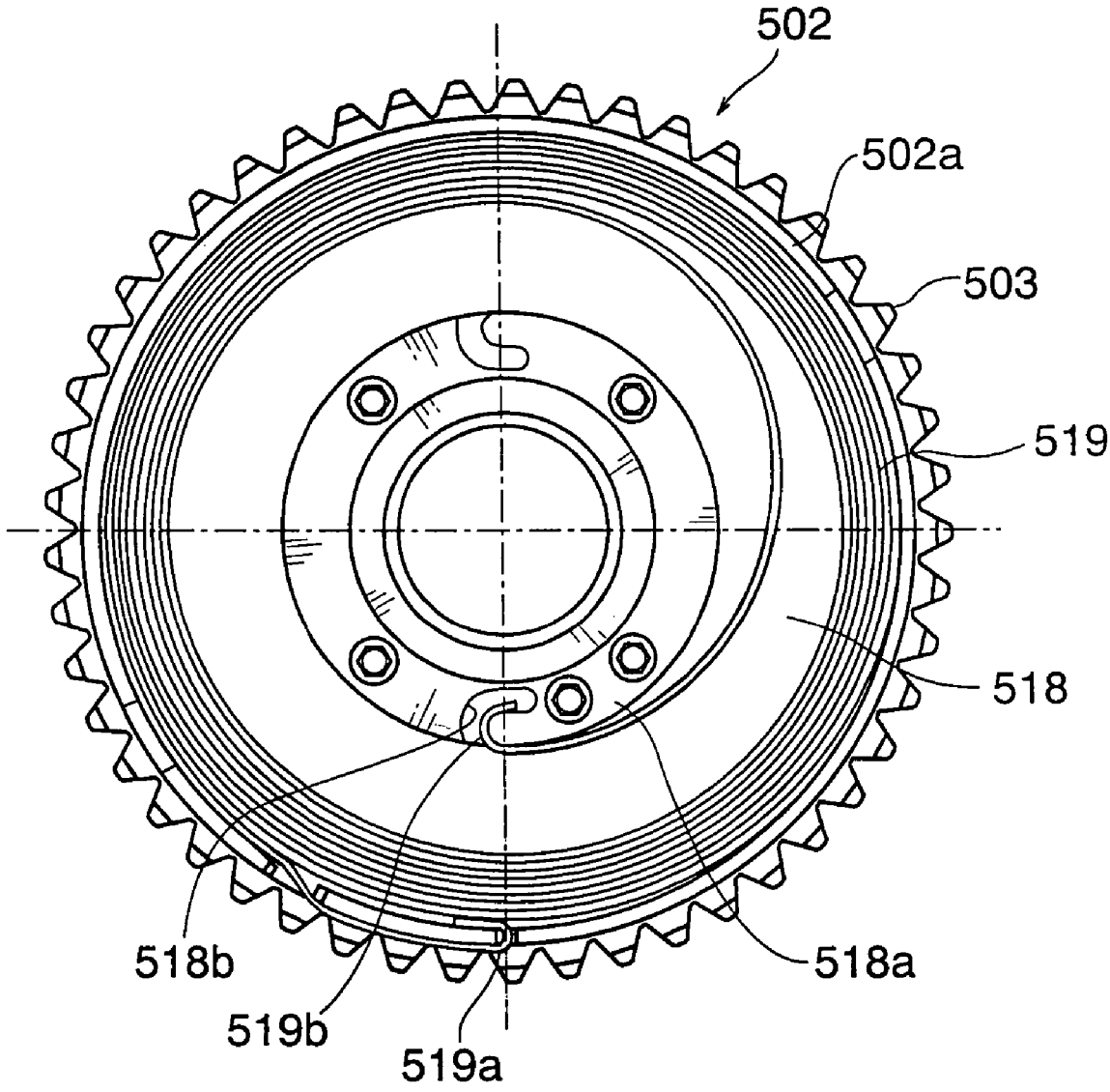
FIG. 16 is a diagram showing a state of attaching a spiral spring in the Variable valve Timing Control mechanism.
Figure 17:
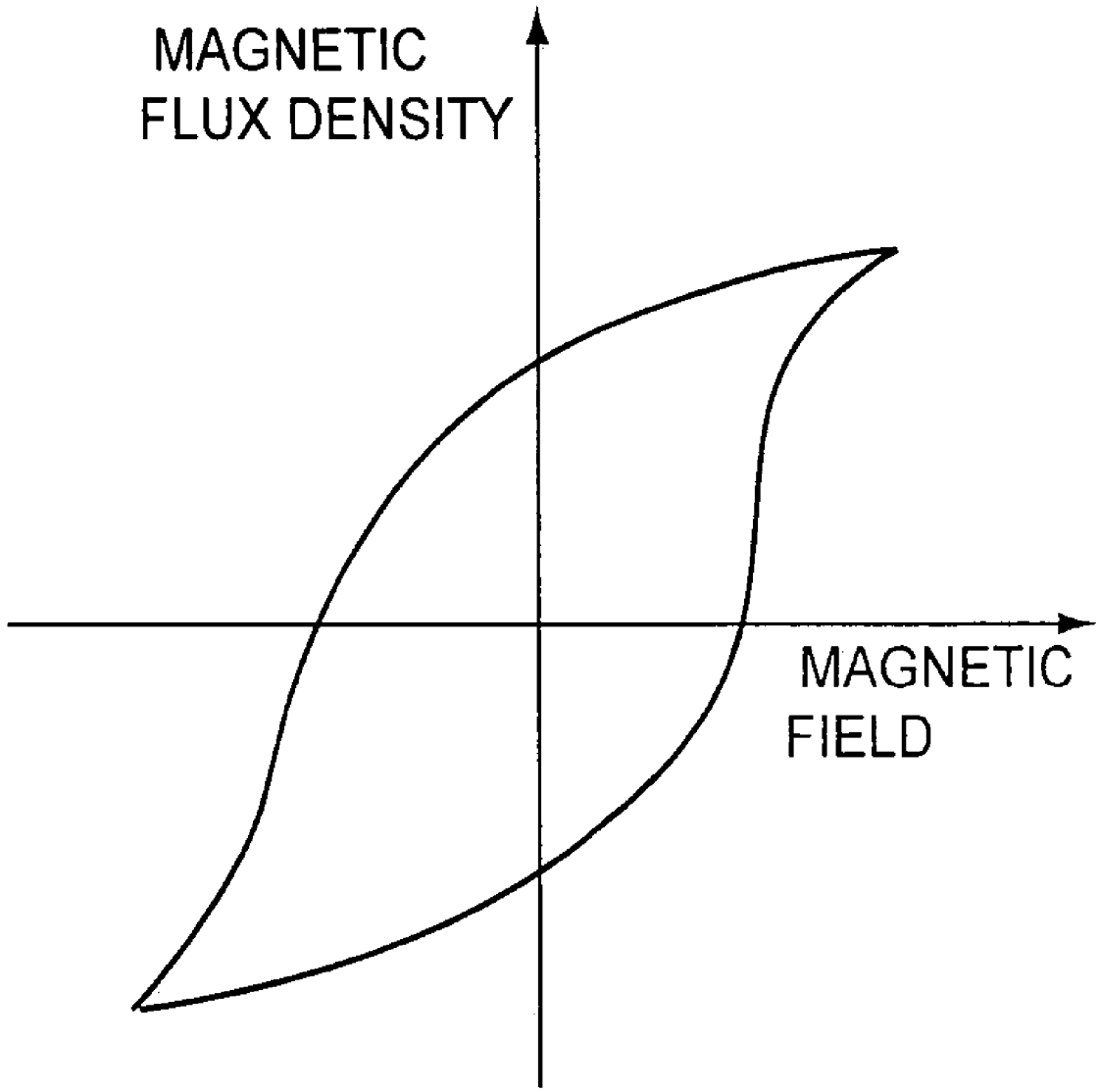
FIG. 17 is a graph showing a characteristic of a variation in a magnetic flux density of a hysteresis material in the Variable valve Timing Control mechanism.

As shown in FIG. 16, spiral spring 519 is disposed in cylinder portion 502*a* of timing sprocket 502, and an outer peripheral end portion 519*a* is engaged with the inner periphery of cylinder portion 502*a*, and an inner peripheral end portion 519*b* is engaged with an engagement slot 518*b* of a base portion 518*a* of intermediate rotator 518.

Hysteresis brake 520 has a hysteresis ring 523, an electromagnetic coil 524 serving as magnetic field control means, and a coil yoke 525 inducing magnetism of electromagnetic coil 524.

Hysteresis ring 523 is attached to the rear end portion of intermediate rotator 518 via a retainer plate 522 and a protrusion 522*a* provided so as to be integrated with the rear end surface of retainer plate 522.

Energizing (exciting current) to electromagnetic coil 524 is controlled by ECU 114 in accordance with a operating state of the engine.

Hysteresis ring 523 is structure from a disk type base portion 523*a*, and a cylinder portion 523*b* connected to the outer periphery side of base portion 523*a* via a screw 523*c*.

It is structured such that base portion 523*a* is connected to retainer plate 522 due to respective protrusions 522*a* being press-fitted into bushes 521 provided at positions at uniform intervals in the circumferential direction.

Further, Hysteresis ring 523 is formed from a material having the characteristic that the magnetic flux is varied so as to have a phase delay with respect to a variation in the external magnetic field (refer to FIG. 17), and cylinder portion 523*b* receives braking effect by coil yoke 525.

Coil yoke 525 is formed so as to surround electromagnetic coil 524, and the outer peripheral surface thereof is fixed to a cylinder head out of the drawing.

Further, the side of the inner periphery of coil yoke 525 supports camshaft 13 to be freely pivotable via a needle bearing 528, and base portion 523*a* side of hysteresis ring 523 is supported so as to freely pivotable by a ball bearing 531.

Then, a pair of facing surfaces 526 and 527 which face one another via a ring-shaped gap are formed at intermediate rotator 518 side of coil yoke 525.

Figure 18:
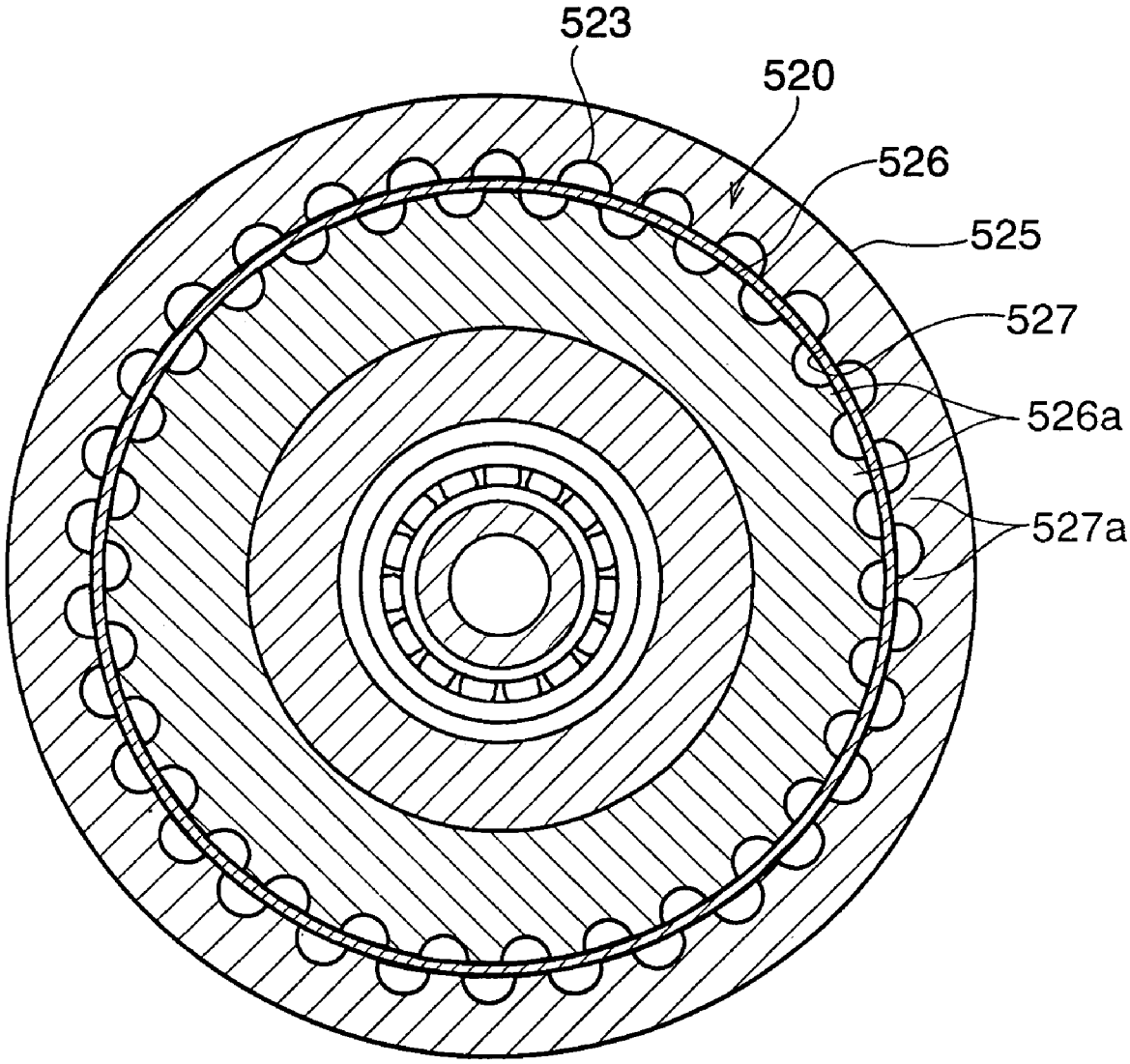
FIG. 18 is a diagram showing a hysteresis brake in the Variable valve Timing Control mechanism.

As shown in FIG. 18, a plurality of convex portions 526*a* and 527*a* which structure a magnetic field generating unit are formed at uniform intervals along the circumferential direction at facing surfaces 526 and 527.

Then, convex portions 526*a* on one facing surface 526 and convex portions 527*a* on the other facing surface 527 are disposed alternately in the circumferential direction, and adjacent convex portions 526*a* and 527*a* of facing surfaces 526 and 527 are entirely shifted in the circumferential direction.

Figure 19:
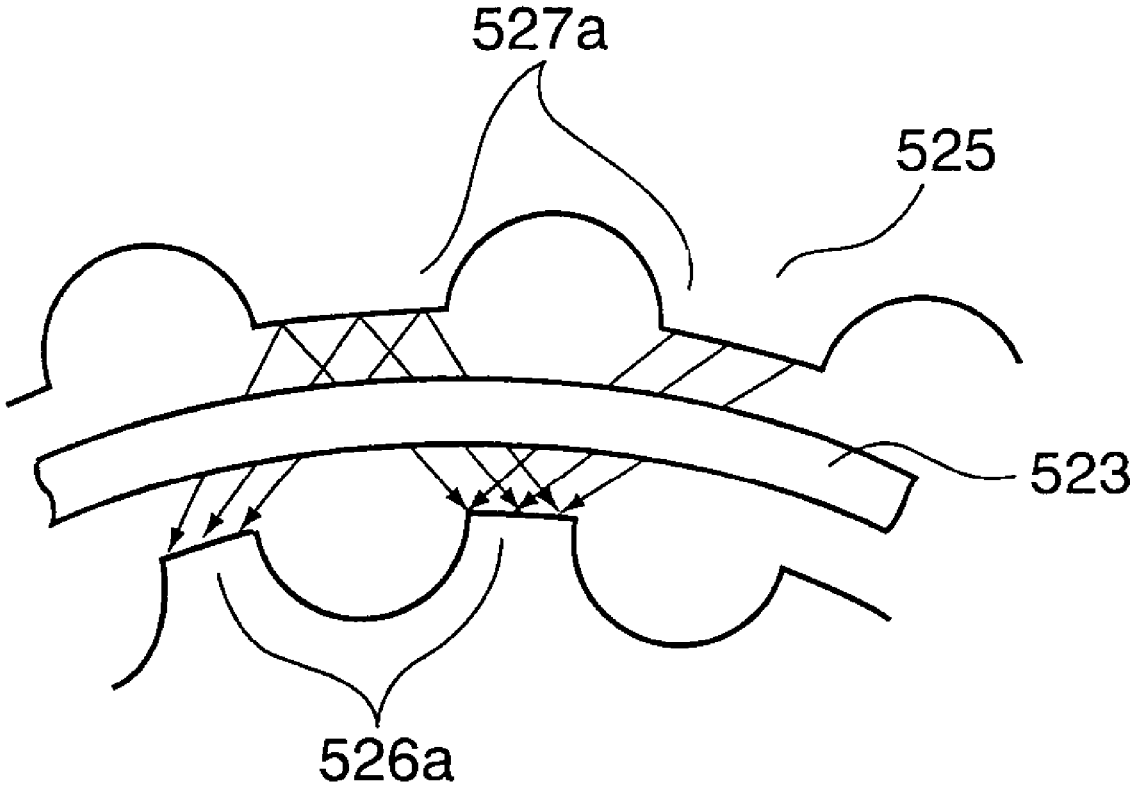
FIG. 19 is a diagram showing directions of magnetic fields in the hysteresis brake.

Accordingly, a magnetic field deflected in the circumferential direction is generated between convex portions 526*a* and 527*a* adjacent to one another of facing surfaces 526 and 527 by excitation of electromagnetic coil 524 (refer to FIG. 19).

Then, cylinder portion 523*a* of hysteresis ring 523 is set in the gap between both facing surfaces 526 and 527 in a non-contacting state.

When hysteresis ring 523 is displaced in the magnetic field between facing surfaces 526 and 527, braking force is generated due to a divergence between the direction of the magnetic flux and the direction of the magnetic field inside hysteresis ring 523.

The braking force is made to be a value which is substantially in proportion to the strength of the magnetic field, i.e., a magnitude of an exciting current of electromagnetic coil 524 regardless of a relative velocity between facing surfaces 526 and 527 and hysteresis ring 523.

Figure 20:
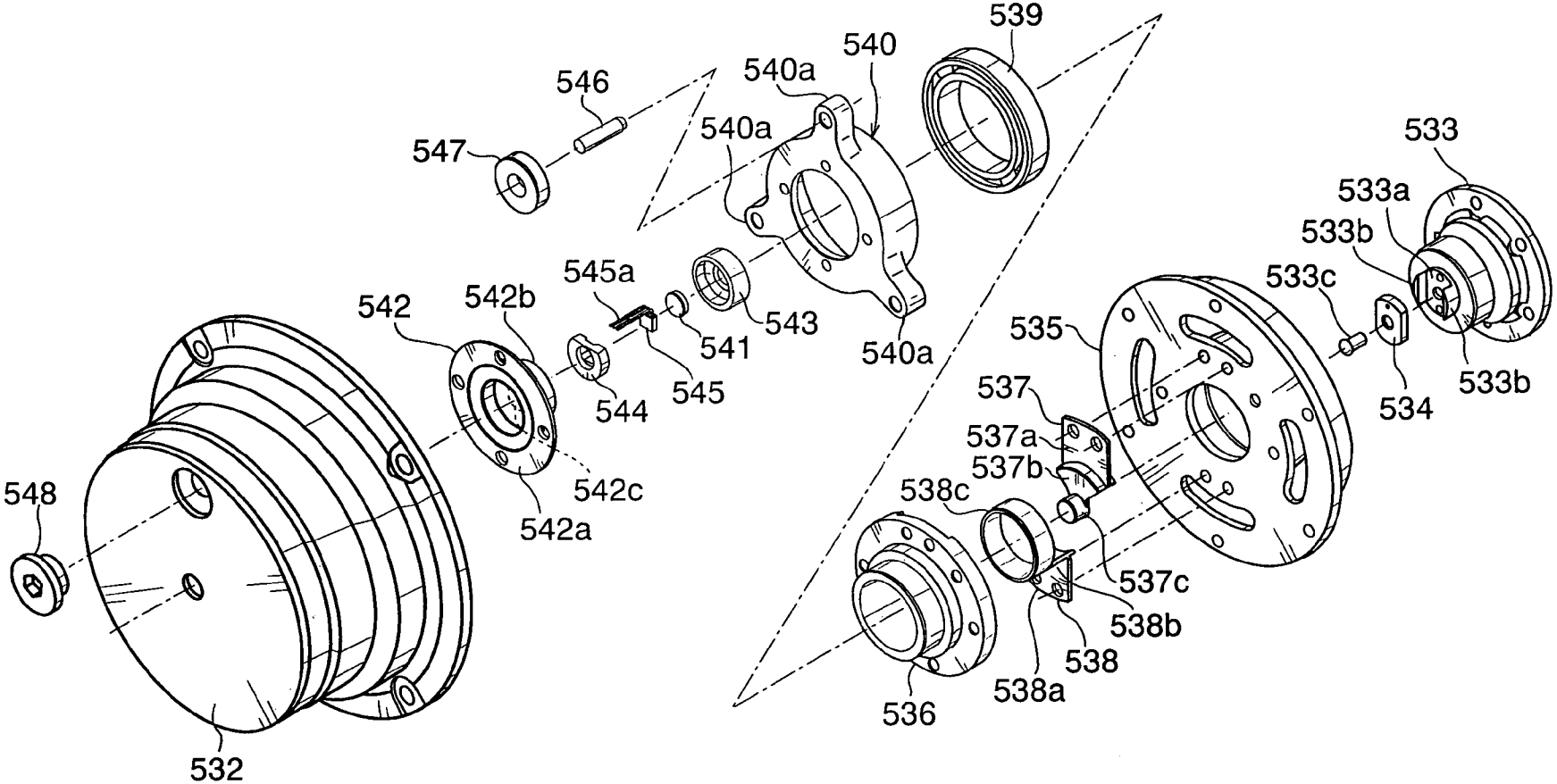
FIG. 20 is an exploded perspective view showing relative displacement detecting means in the Variable valve Timing Control mechanism.
Figure 21:
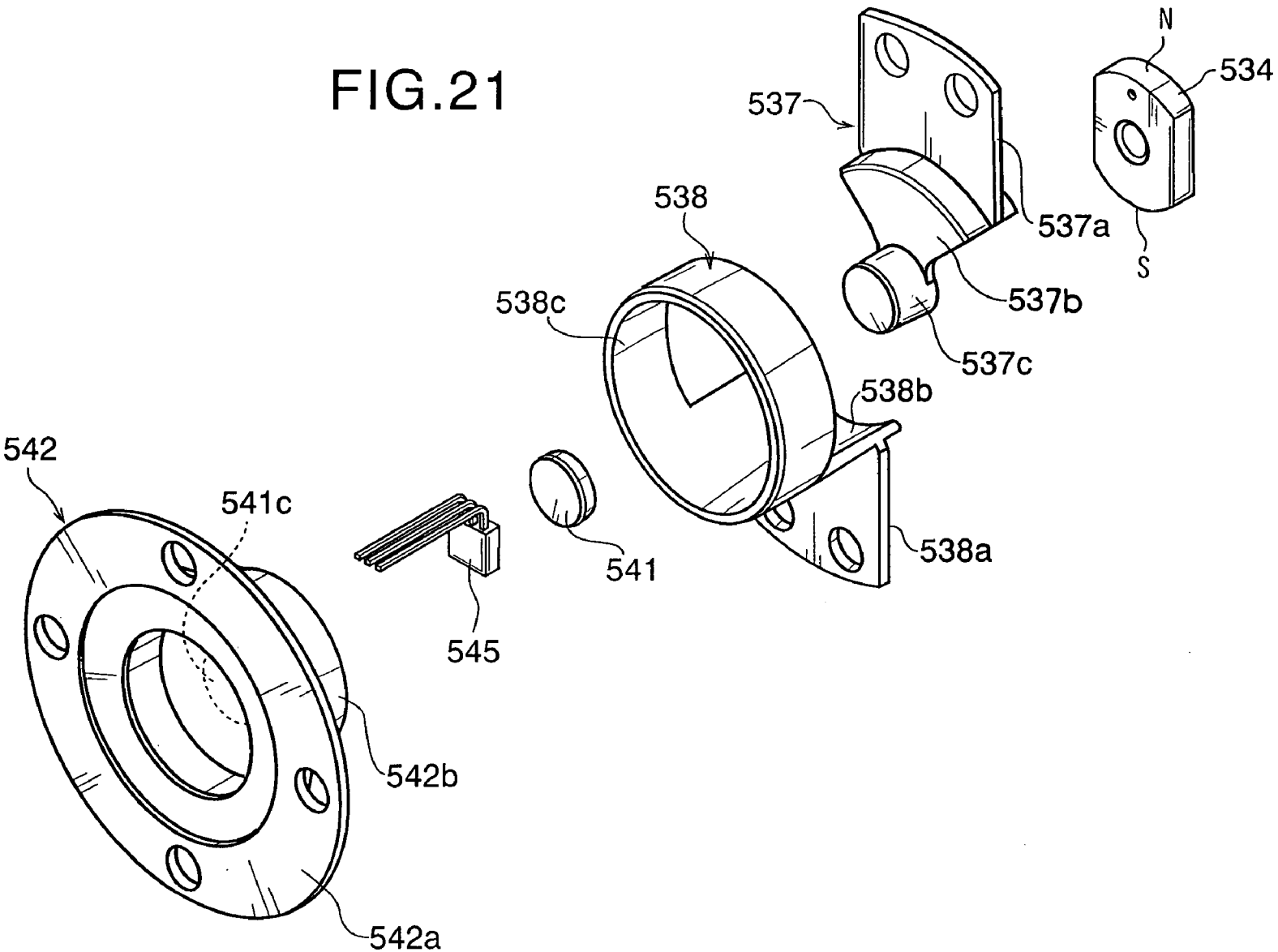
FIG. 21 is elements on large scale of FIG. 20.

As shown in FIG. 12, FIG. 20, and FIG. 21, relative displacement detecting means 506 is structured from a magnetic field generating mechanism provided at driven shaft member 507 side, and a sensor mechanism which is provided at VTC cover 532 side which is the fixing side, and which detects a variation in a magnetic field from magnetic field generating mechanism.

Magnetic field generating mechanism has a magnet base 533 formed from a non-magnetic material fixed at the front end side of flange 507*a*, a permanent magnet 534 which is accommodated in a groove 533*a* formed at the top end portion of magnet base 533, and which is fixed by a pin 533*c*, a sensor base 535 fixed at the top end edge of cylinder portion 502*b* of timing sprocket 502, and a first yoke member 537 and a second yoke member 538 which are fixed at the front end surface of sensor base 535 via a cylindrical yoke holder 536.

Note that a seal member 551 preventing dirt and the like from entering the sensor mechanism is set between the outer peripheral surface of magnet base 533 and the inner peripheral surface of sensor base 535.

As shown in FIG. 20, magnet base 533 has a set of protruded walls 533*b* and 533*b* forming groove 533*a* whose top and bottom are opened, and permanent magnet 534 is accommodated between both protruded walls 533*b* and 533*b*.

Permanent magnet 534 is formed in a long elliptical shape in a direction of elongating groove 533*a*, and the center of the top end portion and the center of the bottom end portion are set to the centers of the north pole and the south pole, respectively.

As shown in FIG. 20 and FIG. 21, first yoke member 537 is structured from a plate shaped base portion 537*a* fixed to sensor base 535, a fan shaped yoke portion 537*b* provided so as to be integrated with the inner peripheral edge of base portion 537*a*, and a cylindrical central yoke portion 537*c* provided so as to be integrated with a pivot portion of fan shaped yoke portion 537*b*.

The rear end surface of central yoke portion 537*c* is disposed at the front surface of permanent magnet 534.

Second yoke member 538 is structured from a plate shaped base portion 538*a* fixed to sensor base 535, a plate shaped circular arc yoke portion 538*b* provided so as to be integrated with the upper end edge of base portion 538*a*, and a ring yoke portion 538*c* provided so as to be integrated with the rear end portion of circular arc yoke portion 538*b* in a same curvature.

Ring yoke portion 538*c* is disposed so as to surround the outer peripheral side of a fourth yoke member 542 which will be described later.

The sensor mechanism has a ring shaped element holder 540, a third yoke member 541 serving as a rectifying yoke, a bottled cylinder shaped forth yoke member 542 serving as a rectifying yoke, a synthetic resin protective cap 543, a protective member 544, and a Hall element 545.

Element holder 540 is disposed at the inside of VTC cover 532, and supports the front end portion of yoke holder 536 so as to be freely rotatable by a ball bearing 539 at the inner peripheral side.

Third yoke member 541 is disposed so as to face central yoke portion 537*c* of first yoke member 537 via an air gap G.

Fourth yoke member 542 is fixed to the inner periphery of element holder 540 by bolts.

Protective cap 543 is fixed to the inner peripheral surface of the cylinder portion of fourth yoke member 542, and supports third yoke member 541.

Protective member 544 is fitted into to be attached to the outer periphery of a cylindrical protrusion 542*c* provided so as to be integrated with the center of the bottom wall of fourth yoke member 542.

Hall element 545 is maintained between third yoke member 541 and protrusion 542*c* of fourth yoke member 542, and a lead wire 545*a* is pulled out of Hall element 545.

At element holder 540, as shown in FIG. 20, three protruding portions 540*a* are integrally provided at uniform intervals in the circumferential direction, and ends of pins 546 are respectively fixed to be press-fitted into fixing holes provided by drilling respective protruding portions 540*a*.

Further, three of holes 532*a* are formed at uniform intervals in the circumferential direction at the inner side of VTC cover 532, and rubber bushes 547 are respectively fixed to the insides of holes 532*a*.

The other end portions of pins 546 are inserted into the holes drilled at the centers of rubber bushes 547, and in accordance therewith, element holder 540 is supported at VTC cover 532.

Further, as shown in FIG. 12, the outer race of ball bearing 539 is fixed so as to be press-fitted into element holder 540.

Further, the outer race of ball bearing 539 is urged in the direction of camshaft 13 due to a spring force of a coil spring 549 set between the inner surface of VTC cover 532 and fourth yoke member 542, and in accordance therewith, positioning in the axis direction is carried out, and generation of looseness is prevented.

Note that a stopper body 548 choking the openings at the outer sides of respective holding holes 506*a* is screwed up on VTC cover 532.

Third yoke member 541 is formed in a disk type, and is disposed so as to face central yoke member 537*c* of first yoke member 537 from the axis direction with an air gap G of a predetermined width (about 1 mm).

Further, an air gap G1 is formed between the inner peripheral surface of ring yoke portion 538*c* of second yoke member 538 and an outer peripheral surface of cylinder portion 542*b* of fourth yoke member 542.

Fourth yoke member 542 has a disk type base portion 542*a* fixed to element holder 540, a small-diameter cylinder portion 542*b* which is provided so as to be integrated with the side end surface of Hall element 545 of base portion 542*a*, and a protrusion 542*c* provided at the bottom wall surrounded by cylinder portion 542*b*.

Protrusion 542*c* is disposed coaxially with permanent magnet 534, central yoke member 537*c* of first yoke member 537, and third yoke member 541.

The lead wire 545*a* of Hall element 545 is connected to ECU 114.

In accordance with VTC mechanism 113 with the above-described structure, during the time when the engine is stopped, due to electromagnetic coil 524 of hysteresis brake 520 being turned off, intermediate rotator 518 is made to rotate at the maximum in the direction in which engine is rotated with respect to timing sprocket 502 by the force of power spring 519 (refer to FIG. 13), and the centric phase of the operating angle of intake valve 105 is maintained at the maximum retard side.

Then, the engine is started to drive from this state, and when electromagnetic coil 524 of hysteresis brake 520 is exited on the basis of a request to vary the centric phase to be at the advance side, braking force against the force of spiral spring 519 is applied to intermediate rotator 518.

In accordance therewith, intermediate rotator 518 is rotated in a direction opposite to timing sprocket 502, and in accordance therewith, engagement pins 516 at the top ends of links 511 are led to spiral slot 515, and the top end portions of links 511 are displaced inward along groove 508 in the radial direction.

Then, as shown in FIG. 14 and FIG. 15, an assembling angle between timing sprocket 502 and driven shaft member 507 is varied to be at the advance side due to the effects of links 511, and the variation to being at the advance side is controlled in accordance with an magnitude of an exciting current of electromagnetic coil 524.

Note that FIG. 14 shows a state at a maximum advance, and FIG. 15 shows a state at an intermediate advance.

Detection of a relative displacement angle by the relative displacement detecting means 506 is carried out as follows.

Figure 22:
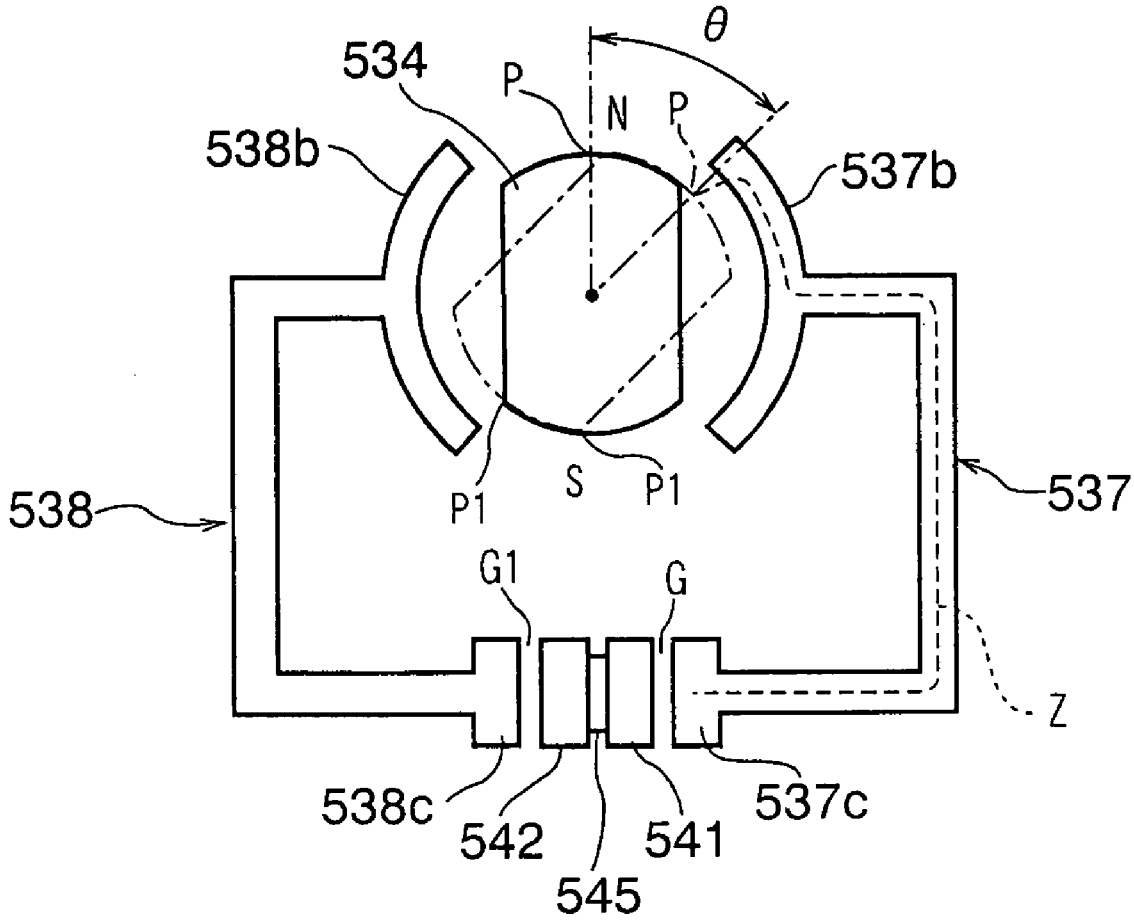
FIG. 22 is a diagram showing a magnetic characteristic in the relative displacement detecting means.

A relative rotational phase between camshaft 13 and timing sprocket 502 is varied, and when permanent magnet 534 of relative displacement detecting means 506 is rotated, for example, by an angle of θ as shown in FIG. 22, a magnetic field Z outputted from the center P of the north pole is transmitted to the fan shaped yoke portion 537*b* of first yoke member 537, and is transmitted to central yoke member 537*c*, and moreover, magnetic field Z is transmitted to Hall element 545 through third yoke member 541 via air gap G.

Magnetic field Z which has been transmitted to Hall element 545 is transmitted to cylinder portion 542*b* via protrusion 542*c* of fourth yoke member 542 from Hall element 545, and is further transmitted to ring yoke portion 538*c* of second yoke member 538 via air gap G1, and is returned to the south pole of permanent magnet 534.

Then, because the magnetic flux density of magnetic field Z is sequentially varied due to the rotational angle θ of permanent magnet 534 being sequentially varied, the sequential variation in the magnetic flux density is detected by Hall element 545, and a variation in the voltages thereof is outputted to ECU 114.

At ECU 114, a relative rotational displacement angle (a advance value of a rotational phase) of camshaft 13 with respect to crankshaft 120 is found by a computation on the basis of the sequential detection signals (variation in the voltages) outputted from Hall element 545 via lead wire 545*a*.

Further, ECU 114 computes a advance target of the rotational phase in VTC mechanism 113, and feedback-controls an exciting current of electromagnetic coil 524 so as to make an actual rotational phase agree with the advance target.

Figure 23:
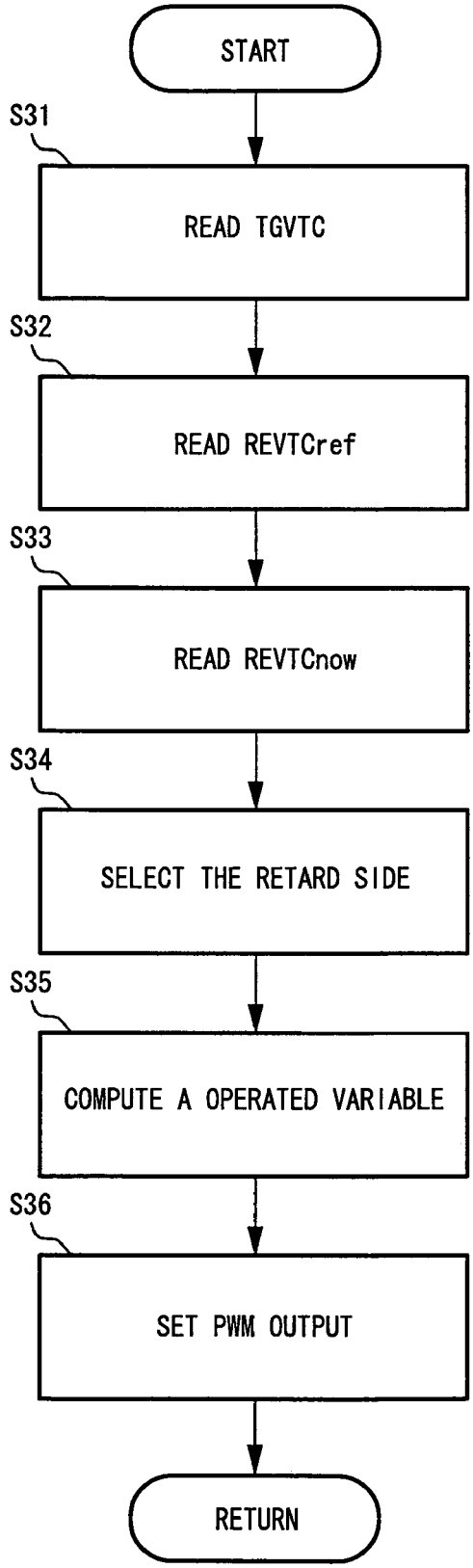
FIG. 23 is a flowchart showing feedback control in the Variable valve Timing Control mechanism.

The flowchart of FIG. 23 shows the main routine of feedback-control of VTC mechanism 113 by ECU 114.

First, at step S31, a target VTC angle TGTVTC which is a advance target of a rotational phase of camshaft 13 with respect to crankshaft 120 is read.

At step S32, an advance value REVTCref of the rotational phase detected on the basis of an angle from a reference rotational position of crankshaft 120 to a reference rotational position of camshaft 13 is read.

The detection of the rotational phase based on the reference rotational positions is carried out by counting unit angle signals POS at an angle from a reference rotational position of crankshaft 120 detected by detecting a position at which a unit angle signal POS from crank angle sensor 117 is omitted up to a position at which a cam signal CAM (a head signal at every crank angle of 180°) is outputted from cam sensor 132.

Figure 24:
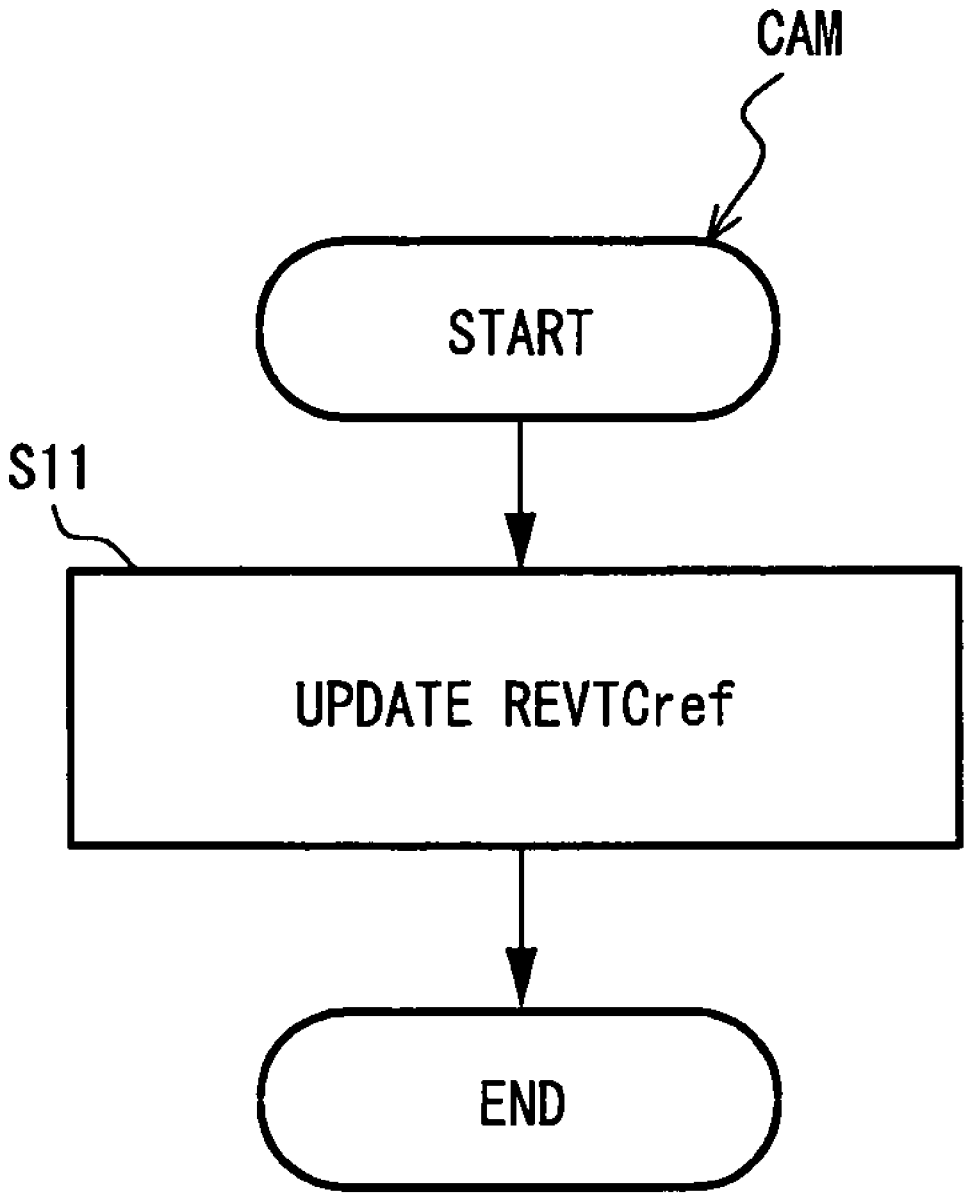
FIG. 24 is a flowchart showing processing for detecting a rotational phase on the basis of detection of reference rotational positions of a crankshaft and a camshaft.

To describe concretely, a counter is made to count up every time of generating a unit angle signal POS, and on the other hand, the counter is made to be reset to 0 at the reference rotational position of crankshaft 120, and at step S11 in the flowchart of FIG. 24 in which an interruption is executed every time when a cam signal CAM (a head signal at every crank angle of 180°) is outputted, a rotational phase is detected by judging a value in the counter at that point in time.

The above-described function corresponds to first detecting means in the present embodiment.

Accordingly, a detected value of the rotational phase based on the reference rotational position is updated every time when a cam signal CAM is outputted from cam sensor 132 (at every crank angle of 180°), and at step S32, a value which has been updated at a time when a latest cam signal CAM is generated is read.

At step S33, an advance value REVTCnow computed on the basis of a detection signal from Hall element 545 (second detecting means) is read.

Because an advance value REVTCref of the rotational phase which is read at step S32 is updated at every constant crank angle, in a case in which an updating period is made long because of low engine rotational speed, time passes during a time from a latest updated timing to a timing of executing the main routine, and when the rotational phase is varied, an error is brought about with respect to an actual rotational phase.

On the other hand, because advance value REVTCnow read at step S33 is determined on the basis of a detection signal from Hall element 545 at that point in time, advance value REVTCnow denotes a rotational phase at that point in time.

At step S34, advance value REVTCref which has been read at step S32 and advance value REVTCnow which has been read at step S33 are compared with one another, and the smaller one, in other words, a value which is further at the retard side is selected.

Then, at step S35, a feedback-controlled amount of VTC mechanism 113 (an exciting current value of electromagnetic coil 524) is computed on the basis of a deviation between advance value of the rotational phase selected at step S34 and a target advance value TGVTC at that point in time.

At step S36, a duty signal for controlling the exciting current is outputted in accordance with the feedback-controlled amount.

In the present embodiment in which a cylinder intake air quantity is controlled by adjusting a lift of intake valve 105 by VEL mechanism 112 and adjusting a centric phase of an operating angle by VTC mechanism 113, the retard side of the centric phase is the direction in which an air quantity is further increased.

Accordingly, selection of a value which is further at the retard side between advance value REVTCref and advance value REVTCnow means that it is judged that a centric phase at this moment in time is further at the retard side, and the centric phase is controlled to be further at the advance side than the case in which a value which is at the advance side is selected, and the centric phase is controlled to be at a side at which an intake air quantity is decreased.

As the present embodiment, in a case of a structure in which an intake air quantity of the engine is controlled by adjusting a lift of intake valve 105 by VEL mechanism 112, because a variation in an air quantity with respect to a variation in a centric phase is made large at low valve lift, when the rotational phase is controlled on the basis of a detected result which is further at the advance side than an actual value during the retard control, the center of the operating angle of the intake valve is excessively set at a retard, and as a result, there is the possibility that a cylinder intake air quantity is increased beyond a request.

In contrast thereto, as described above, provided that a value which is further at the retard side between advance value REVTCref and advance value REVTCnow is selected, VTC mechanism 113 can be controlled on the basis of advance value REVTCnow which is closer to an actual value when a delay in updating advance value REVTCref during the retard control is brought about, and an intake air quantity is prevented from being increased beyond a request due to an excess retard control.

Moreover, even when one of advance value REVTCref and advance value REVTCnow is made to be a value greatly different from an actual value due to a failure of the sensor, by carrying out a feedback-control by selecting a value which is further at the retard side, at least, it can be suppressed that the rotational phase is set excessively at a retard.

Accordingly, due to a value which is further at the retard side between advance value REVTCref and advance value REVTCnow being selected, the engine output is controlled so as to be further reduced, and the centric phase of the operating angle of intake valve 105 is controlled so as to be at a safer side.

Figure 25:
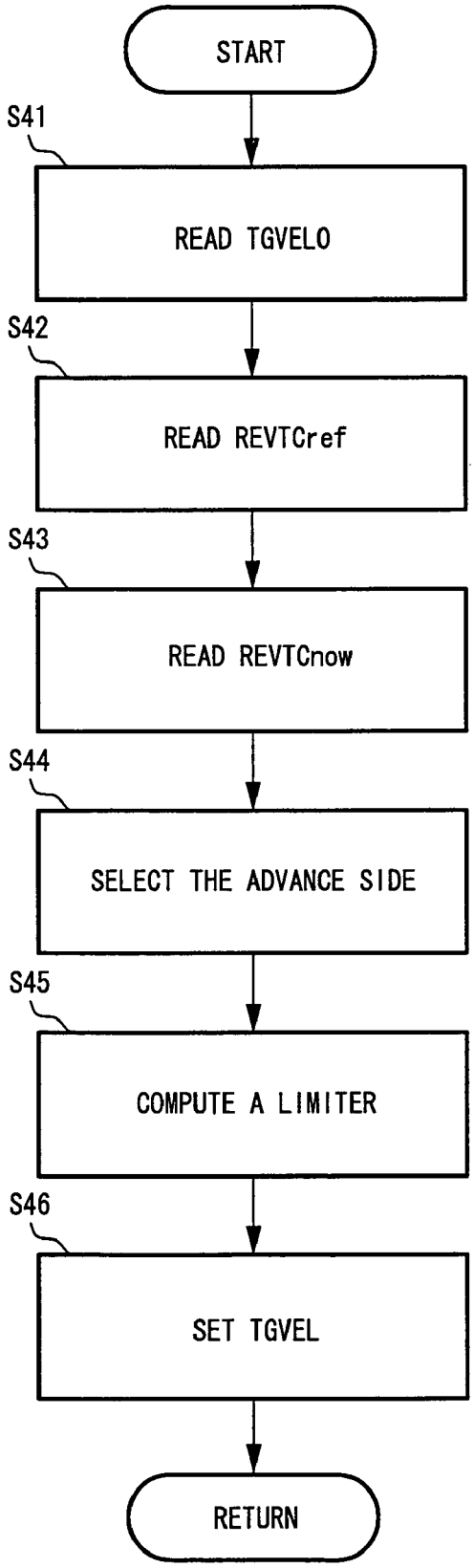
FIG. 25 is a flowchart showing processing for limiting a phase-control angle in the Variable valve Timing Control mechanism.

On the other hand, in a lift/operating angle control by VEL mechanism 112, because limit values of a lift/an operating angle are varied in accordance with the center of an operating angle at that point in time, ECU 114 sets the limit values by the main routine shown in the flowchart of FIG. 25, and limits the operation of VEL mechanism 112.

In the flowchart of FIG. 25, at step S41, a target angle TGVEL0 of control shaft 16 in VEL mechanism 112 is read.

At step S42, in the same way as at step S32, a most up-to-date value of advance value REVTCref of the rotational phase which is detected/updated for each cam signal CAM from cam sensor 132 is read.

At step S43, in the same way as at step S33, advance value REVTCnow computed on the basis of a detection signal from Hall element 545 (the second detecting means) is read.

Then, at step S44, advance value REVTCref read at step S42 and advance value REVTCnow read at step S43 are compared with one another, a value which is greater than the other value, in other words, a value which is further at the advance side is selected.

At step S45, an angle limiter is computed on the basis of advance value of the rotational phase selected at step S44.

The angle limiter is set at an angle that a maximum operating angle or a maximum lift of intake valve 105 which can avoid the interference between a piston and intake valve 105 is determined on the basis of the advance value of the rotational phase selected at step S44, and the maximum operating angle or the maximum lift is converted into an angle of control shaft 16 of VEL mechanism 112.

At step S46, target angle TGVEL0 is limited so as to be not over the angle limiter, and a final target angle TGVEL is set.

To compare the cases in a state of the same operating angle/lift, the more the centric phase of the operating angle of intake valve 105 is set at an advance, the shorter the distance between the piston and intake valve 105 at the top dead center is.

Accordingly, provided that the angle limiter is set on the basis of a value which is further at the advance side between advance value REVTCref and advance value REVTCnow, target angle TGVEL is limited so as to ensure the distance between the piston and intake valve 105 at the top dead center so as to be longer, which can exactly avoid the interference between the piston and intake valve 105.

In accordance therewith, it can be avoided that the operating angle/the lift are controlled so as to be an operating angle/a lift which bring about the interference between the piston and intake valve 105 at the time of transitionally varying a rotational phase or when the sensor breaks down.

In the present embodiment, Hall element 545 detecting a variation in a magnetic flux density due to a variation in a rotational angle of permanent magnet 534 is used as the second detecting means detecting an advance value REVTCnow. However, due to a second cam sensor 133 shown in FIG. 26 being provided in place of Hall element 545, and by combining second cam sensor 133 and crank angle sensor 117, second detecting means which can detect the centric phase of intake valve 105 in an arbitrary timing can be structured.

Figure 26:
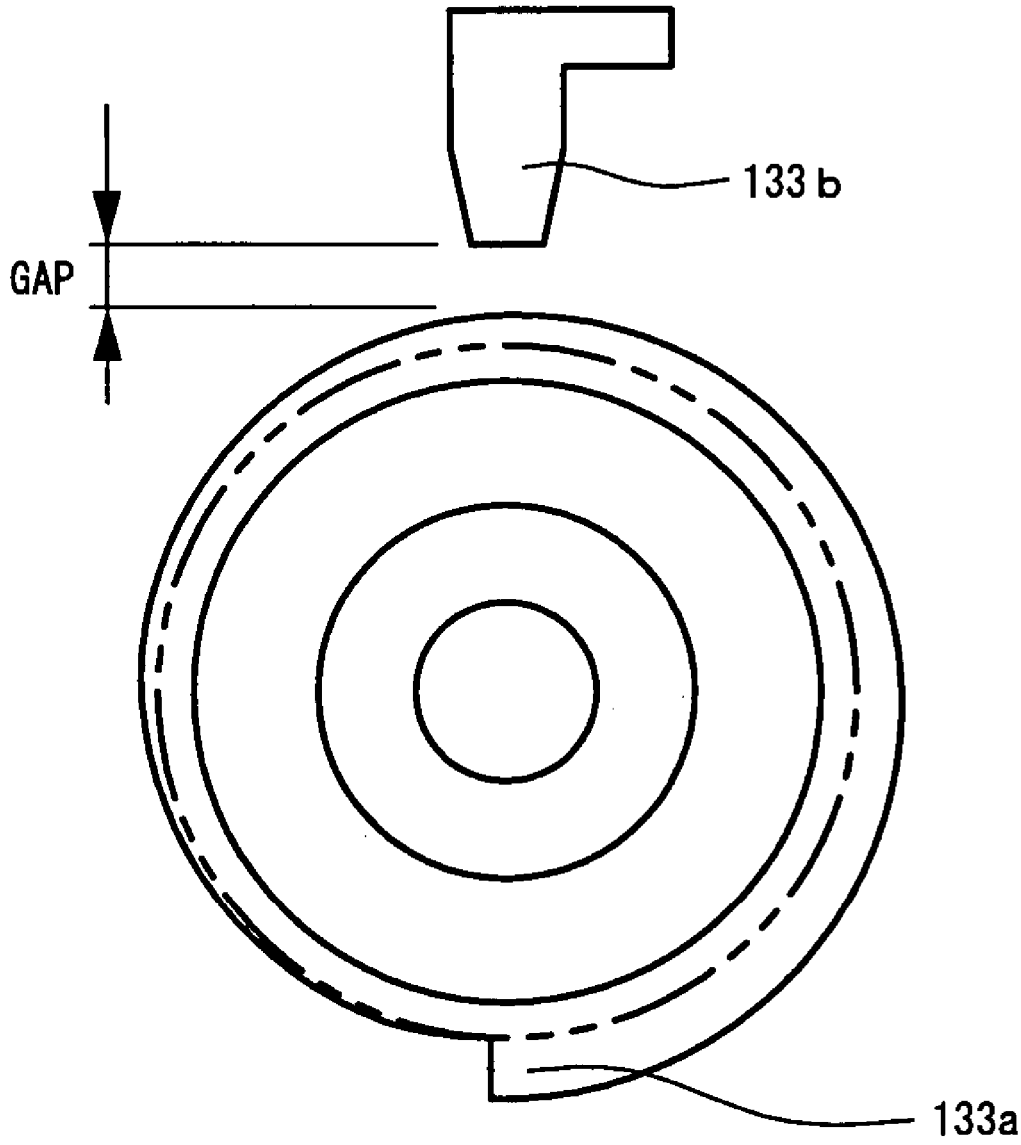
FIG. 26 is a diagram showing a structure of a second cam sensor in the embodiment.
Figure 27:
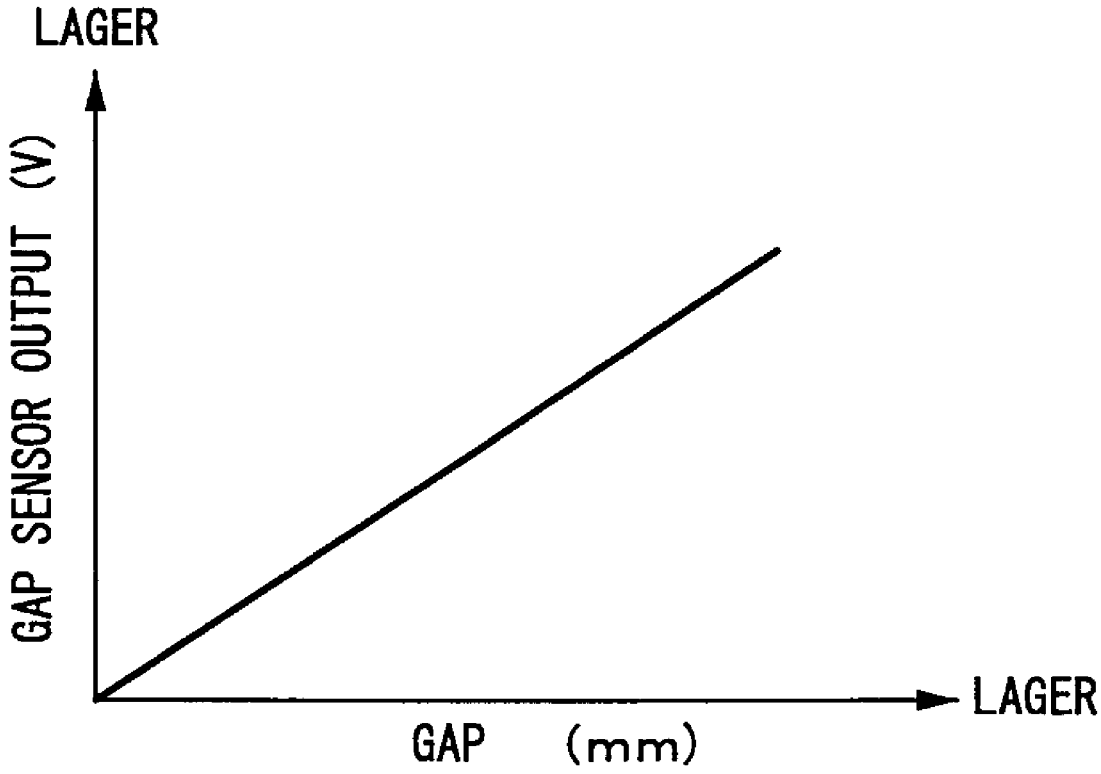
FIG. 27 is a graph showing an output characteristic of a gap sensor in the embodiment.

As shown in FIG. 26, second cam sensor 133 is formed such that the radius of a rotator 133*a* rotating so as to be integrated with camshaft 13 is sequentially varied in the circumferential direction, and the output of a gap sensor 133*b* fixed so as to face the peripheral edge of rotator 133*a* is structured, as shown in FIG. 27, so as to be sequentially varied due to a distance between gap sensor 133*b* and the peripheral edge of rotator 133*a* being varied by the rotations of the camshaft.

Figure 28:
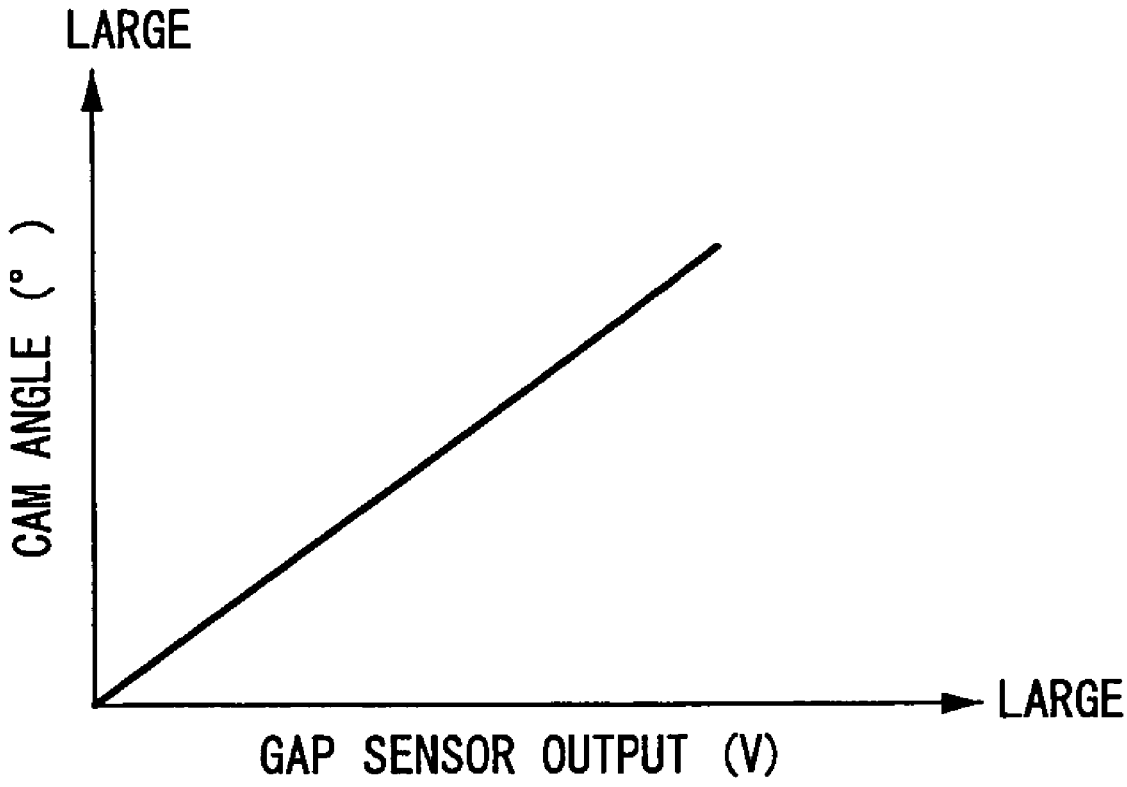
FIG. 28 is a graph showing a correlation between an angle of the camshaft and an output of a gap sensor.

Here, because the relationship between the angle position of the camshaft and the gap is constant, as shown in FIG. 28, the output of gap sensor 133*b* and the angle position of the camshaft have a constant correlation, and the angle position of the camshaft can be detected on the basis of the output of gap sensor 133*b*.

Here, suppose that the output of gap sensor 133*b* is a cam angle signal CAMA.

The angle position of crankshaft 120 is detected by counting a number of generating unit angle signals POS from a reference rotational position of crankshaft 120 detected by detecting a position at which unit angle signal POS from crank angle sensor 117 is omitted, and the angle position of camshaft 13 is detected on the basis of cam angle signal CAMA from second cam sensor 133.

Provided that the number of generating unit angle signals POS from the reference rotational position of crankshaft 120 are made to be always counted, an angle position of crankshaft 120 can be determined in an arbitrary timing with a minimum unit being as 10°, and an angle position of camshaft 13 can be determined in an arbitrary timing by reading a cam angle signal CAMA from second cam sensor 133 (an output of gap sensor 133*b*).

Figure 29:
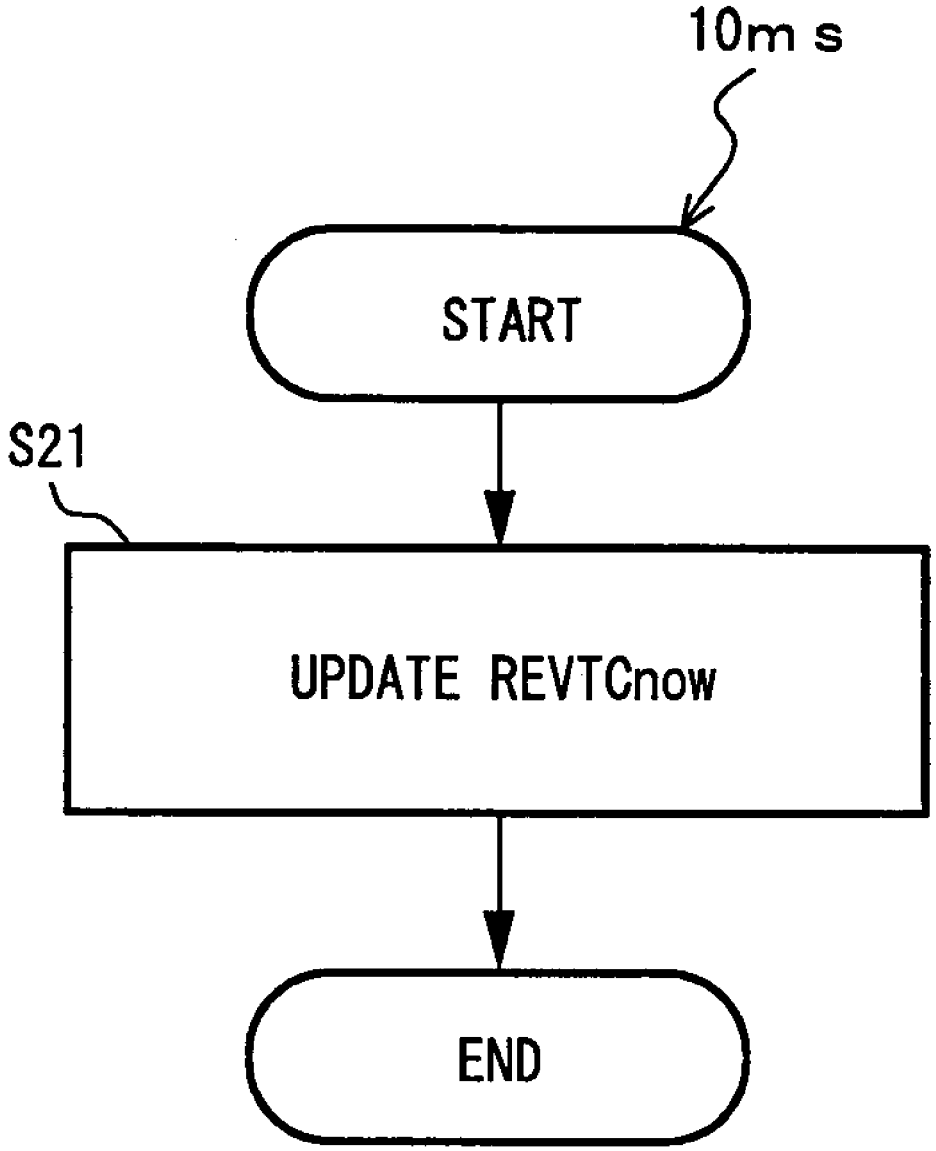
FIG. 29 is a flowchart showing processing for detecting a rotational phase on the basis of detection of angles of the crankshaft and the camshaft.

Then, at step S21 in the flowchart of FIG. 29 in which an interruption is executed in every predetermined microtime (for example, 10 ms), an advance value REVTCnow of the rotational phase of camshaft 13 with respect to crankshaft 120 is detected on the basis of an angle position of crankshaft 120 and an angle position of camshaft 13 at that point in time.

Then, at the steps S33 and S43, a most up-to-date value of advance value REVTCnow which has been determined at the step S21 is made to be read.

Advance value REVTCnow determined at step S21 is a most up-to-date value of the value which is updated in every microtime, and is not greatly delayed as compared with advance value REVTCref, and is made to have necessary and sufficient detecting responsiveness in place of Hall element 545.

Note that, due to a sensor detecting an angle position by a gap sensor being provided at crankshaft 120 side, a centric phase can be detected in an arbitrary timing on the basis of detected results of the gap sensor at crankshaft 120 side and gap sensor 133*b*.

Note that a mechanism which can vary a rotational phase of camshaft 13 with respect to crankshaft 120, and a mechanism which can vary an operating angle/a lift are not limited to VTC mechanism 113 and VEL mechanism 112 described above, and well-known mechanisms can be appropriately used.

Further, an engine valve which can vary the opening characteristic is not limited to intake valve 105, and it may be a structure in which VTC mechanism 113 and VEL mechanism are provided at exhaust valve 107 side, and means corresponding to the first detecting means and the second detecting means are provided, and between the results of detecting a centric phase by those means, a result in which the opening characteristic of the exhaust valve is controlled so as to be at a safer side is selected, and the opening characteristic of the exhaust valve is controlled on the basis of the selected result of detecting the centric phase.

For example, because the distance between exhaust valve 107 and the piston at the top dead center is made shorter as the centric phase is set to be further at a retard, provided that an operating angle/a lift of the exhaust valve is limited by selecting a detected result further at the retard side, the opening characteristic of the exhaust valve is controlled to be at a safer side.

Further, diagnoses of various sensors used for detecting a centric phase are separately carried out, and on condition that a sensor is normal, processing in which one of the both detected results is selected only at low engine speed by which an updating period of advance value REVTCref is made longer may be carried out, or processing in which one of the both detected results is selected only in a state in which the centric phase is in transition may be carried out, and moreover, processing in which one of the both detected results is selected with a direction of transitionally varying the rotational phase being limited may be carried out.

Further, advance value REVTCnow can be calibrated on the basis of advance value REVTCref.

The entire contents of Japanese Patent Application NO. 2004-051639, filed Feb. 26, 2004 and Japanese Patent Application NO. 2004-380637, filed Dec. 28, 2004 are incorporated herein by reference.

While only selected embodiments have been chosen to illustrate the present invention, it will be apparent to those skilled in the art from this disclosure that various change and modification can be made herein without departing from the scope of the invention as defined in the appended claims.

Furthermore, the foregoing description of the embodiments according to the present invention are provided for illustration only, and not for the purpose of limiting the invention as defined by the appended claims and their equivalents.

We claim:

1. A variable valve operating control apparatus for an internal combustion engine comprising:

a Variable valve Timing Control mechanism which makes a centric phase of an operating angle of an engine valve variable due to a rotational phase of a camshaft with respect to a crankshaft being varied;

a first detecting unit which detects a centric phase of an operating angle of the engine valve on the basis of an interval between a reference rotational position of the crankshaft and a reference rotational position of the camshaft;

a second detecting unit which detects a centric phase of an operating angle of the engine valve at a period shorter than that by the first detecting unit;

a selecting unit which selects one of the centric phase detected of late by the first detecting unit and the centric phase detected of late by the second detecting unit, on the basis of a predetermined regulation; and an operating unit which operates an opening characteristic of the engine valve on the basis of the centric phase selected by the selecting unit.

2. A variable valve operating control apparatus for an internal combustion engine according to claim 1, wherein the selecting unit selects one in which the opening characteristic of the engine valve is operated so as to be at a safer side between the centric phase detected of late by the first detecting unit and the centric phase detected of late by the second detecting unit.

3. A variable valve operating control apparatus for an internal combustion engine according to claim 1, wherein the operating unit outputs an operate signal to the Variable valve Timing Control mechanism on the basis of the centric phase selected at the selecting unit and a target value for the centric phase.

4. A variable valve operating control apparatus for an internal combustion engine according to claim 3, wherein the Variable valve Timing Control mechanism makes a centric phase of an operating angle of an intake valve variable, and the selecting unit selects one which is further at a retard side, between the centric phase detected of late by the first detecting unit and the centric phase detected of late by the second detecting unit.

5. A variable valve operating control apparatus for an internal combustion engine according to claim 1, further comprising a Variable valve Event and Lift mechanism which makes an operating angle and a lift of the engine valve variable, wherein the operating unit sets a limit value of a operated amount of the Variable valve Event and Lift mechanism on the basis of the centric phase selected at the selecting unit, and operates the Variable valve Event and Lift mechanism within the limit value.

6. A variable valve operating control apparatus for an internal combustion engine according to claim 5, wherein the selecting unit selects one by which a distance between the engine valve and a piston at a piston top dead center is made shorter, between the centric phase detected of late by the first detecting unit and the centric phase detected of late by the second detecting unit.

7. A variable valve operating control apparatus for an internal combustion engine according to claim 1, wherein the first detecting unit comprises a crank angle sensor generating a detection signal at a reference rotational position of the crankshaft, a cam sensor generating a detection signal at a reference rotational position of the camshaft, a measuring unit which measures a interval between a detection signal at a reference rotational position of the crankshaft and a detection signal at a reference rotational position of the camshaft, and a computing unit which computes the centric phase on the basis of the interval.

8. An variable valve operating control apparatus for an internal combustion engine according to claim 1, wherein the second detecting unit comprises a sensor whose output sequentially varies in accordance with a variation in a centric phase of an operating angle of the engine valve.

9. An variable valve operating control apparatus for an internal combustion engine according to claim 1, wherein the second detecting unit is structured such that a permanent magnet is provided at one side of a member which is relatively rotated in accordance with an operating state of the Variable valve Timing Control mechanism, and a yoke is provided at the other side thereof, and a clearance between a center of a magnetic pole of the permanent magnet and the yoke is varied by the relative rotation, and detects a variation in a magnetic flux density due to a variation in the clearance.

10. An variable valve operating control apparatus for an internal combustion engine according to claim 9, wherein the second detecting unit detects a variation in the magnetic flux density by a Hall element.

11. An variable valve operating control apparatus for an internal combustion engine according to claim 1, wherein the second detecting unit comprises a rotator which rotates so as to be integrated with the camshaft, and whose radius sequentially varies in a circumferential direction, a distance sensor which is fixed so as to face onto a peripheral edge of the rotator, and which outputs a detection signal in accordance with a variation in a relative distance with the peripheral edge of the rotator, a crank angle sensor which detects a rotational angle of the crankshaft at every micro-rotational angle, and a computing unit which computes a centric phase of an operating angle of the engine valve on the basis of a rotational angle of the camshaft detected on the basis of an output of the distance sensor and a rotational angle of the crankshaft detected at the crank angle sensor.

12. An variable valve operating control apparatus for an internal combustion engine according to claim 1, wherein the second detecting unit comprises a first rotator which rotates so as to be integrated with the camshaft, and whose radius sequentially varies in a circumferential direction, a first distance sensor which is fixed so as to face onto a peripheral edge of the first rotator, and which outputs a detection signal corresponding to a variation in a relative distance with the peripheral edge of the first rotator, a second rotator which rotates so as to be integrated with the crankshaft, and whose radius sequentially varies in a circumferential direction, a second distance sensor which is fixed so as to face onto a peripheral edge of the second rotator, and which outputs a detection signal corresponding to a variation in a relative distance with the peripheral edge of the second rotator, and a computing unit which computes a centric phase of an operating angle of the engine valve on the basis of a rotational angle of the camshaft detected on the basis of an output of the first distance sensor and a rotational angle of the crankshaft detected on the basis of an output of the second distance sensor.

13. An variable valve operating control apparatus for an internal combustion engine according to claim 1, wherein the Variable valve Timing Control mechanism comprises a driving member to which a turning force is transmitted from the crankshaft, a driven member which is provided so as to be integrated with the camshaft, an intermediate rotator which is provided between the driving member and the driven member, and which accelerates and decelerates a rotation transmitted to the driven member by being relatively rotated with respect to the driving member, and an electromagnetic actuator which makes the intermediate rotator relatively rotate with respect to the driving member.

14. An variable valve operating control apparatus for an internal combustion engine comprising:

a Variable valve Timing Control mechanism which makes a centric phase of an operating angle of an engine valve variable due to a rotational phase of a camshaft with respect to a crankshaft being varied;

first detecting means for detecting a centric phase of an operating angle of the engine valve on the basis of an interval between a reference rotational position of the crankshaft and a reference rotational position of the camshaft;

second detecting means for detecting a centric phase of an operating angle of the engine valve at a period shorter than that by the first detecting means;

selecting means for selecting one of the centric phase detected of late by the first detecting means and the centric phase detected of late by the second detecting means, on the basis of a predetermined regulation; and operating means for operating an opening characteristic of the engine valve on the basis of the centric phase selected at the selecting means.

15. A method for controlling an internal combustion engine which has a Variable valve Timing Control mechanism which makes a centric phase of an operating angle of an engine valve variable due to a rotational phase of a camshaft with respect to a crankshaft being varied, comprising the steps of:

detecting a centric phase of an operating angle of the engine valve at every reference rotational position on the basis of an interval between a reference rotational position of the crankshaft and a reference rotational position of the camshaft;

detecting a centric phase of an operating angle of the engine valve at a period shorter than a period between the reference rotational positions;

selecting one of a most up-to-date value of the centric phase detected at every reference rotational position and a most up-to-date value of the centric phase detected at a period shorter than the period between the reference rotational positions on the basis of a predetermined regulation; and operating an opening characteristic of the engine valve on the basis of the selected centric phase.

16. A method for controlling an internal combustion engine according to claim 15, wherein the step of selecting one of the two centric phases comprises a step of selecting one by which an opening characteristic of the engine valve is operated so as to be at a safer side, between a most up-to-date value of the centric phase detected at every reference rotational position and a most up-to-date value of the centric phase detected at a period shorter than the period between the reference rotational positions.

17. A method for controlling an internal combustion engine according to claim 15, wherein the step of operating the opening characteristic of the engine valve comprises a step of outputting a operate signal to the Variable valve Timing Control mechanism on the basis of the selected centric phase and a target value for the centric phase.

18. A method for controlling an internal combustion engine according to claim 17, wherein the Variable valve Timing Control mechanism makes a centric phase of an operating angle of an intake valve variable, and the step of selecting one of the two centric phases comprises a step of selecting one which is further at retard side, between a most up-to-date value of the centric phase detected at every reference rotational position and a most up-to-date value of the centric phase detected at a period shorter than the period between the reference rotational positions.

19. A method for controlling an internal combustion engine according to claim 15, wherein the internal combustion engine further has a Variable valve Event and Lift mechanism which makes an operating angle and a lift of the engine valve variable, and the step of operating the opening characteristic of the engine valve comprises the steps of;

setting a limit value of a operated amount of the Variable valve Event and Lift mechanism on the basis of the selected centric phase, and operating the Variable valve Event and Lift mechanism within the limit value.

20. A method for controlling an internal combustion engine according to claim 19, wherein the step of selecting one of the two centric phases comprises a step of selecting one by which a distance between the engine valve and a piston at a piston top dead center is made shorter, between a most up-to-date value of the centric phase detected at every reference rotational position and a most up-to-date value of the centric phase detected at a period shorter than the period between the reference rotational positions.

* * * * *